US005914658A

United States Patent [19]

Arakawa

[11] Patent Number: 5,914,658

[45] Date of Patent: Jun. 22, 1999

[54] CRIME PREVENTION DISPLAY DEVICE, EXHIBIT CRIME PREVENTION ALARM CONTROL METHOD AND APPARATUS THEREFOR

[76] Inventor: Hideo Arakawa, 15-15, Zenpukuji 4-chome, Suginami-ku, Tokyo, Japan

[21] Appl. No.: 08/871,241

[22] Filed: Jun. 9, 1997

Related U.S. Application Data

[62] Division of application No. 08/335,734, Nov. 9, 1994, Pat. No. 5,638,049.

[30] Foreign Application Priority Data

| | | | |
|---|---|---|---|
| Mar. 11, 1993 | [JP] | Japan | 5-76485 |
| Mar. 15, 1993 | [JP] | Japan | 5-78579 |
| Dec. 28, 1993 | [JP] | Japan | 5-349193 |

[51] Int. Cl.[6] ..... G08B 13/14

[52] U.S. Cl. ..... 340/568.8; 340/665; 340/666; 340/668; 340/693.9; 340/531; 367/199

[58] Field of Search ..... 340/568, 665, 340/666, 668, 693, 531, 545; 367/199

[56] References Cited

U.S. PATENT DOCUMENTS

| | | | |
|---|---|---|---|
| 3,145,375 | 8/1964 | Webb | 340/568 |
| 3,668,680 | 6/1972 | Spalding et al. | 340/568 |
| 3,760,402 | 9/1973 | Magerle et al. | 340/568 |
| 3,778,806 | 12/1973 | Williams | 340/545 |
| 3,887,909 | 6/1975 | Beiswenger et al. | 340/568 |
| 4,058,792 | 11/1977 | Soltesz | 340/568 |
| 4,417,235 | 11/1983 | Del Grande | 340/506 |
| 4,450,436 | 5/1984 | Massa | 340/531 |
| 4,542,373 | 9/1985 | Hillock | 340/568 |
| 4,654,640 | 3/1987 | Carll et al. | 340/588 |
| 4,698,615 | 10/1987 | Wilber | 340/568 |
| 4,857,892 | 8/1989 | Risidan | 340/568 |
| 5,231,375 | 7/1993 | Sanders et al. | 340/568 |
| 5,266,920 | 11/1993 | Langner | 340/568 |
| 5,417,400 | 5/1995 | Arakawa | 248/323 |

FOREIGN PATENT DOCUMENTS

| | | |
|---|---|---|
| 3738135 | of 0000 | Germany . |
| 1187879 | of 0000 | Japan . |
| 2144332 | of 0000 | Japan . |
| 4835514 | of 0000 | Japan . |
| 4987054 | of 0000 | Japan . |
| 55-112692 | of 0000 | Japan . |
| 57-148199 | of 0000 | Japan . |
| 62-275469 | of 0000 | Japan . |
| 63-306181 | of 0000 | Japan . |
| 64-213040 | of 0000 | Japan . |
| 94 20936 | of 0000 | WIPO . |

*Primary Examiner*—Benjamin C. Lee
*Attorney, Agent, or Firm*—Price Gess & Ubell

[57] ABSTRACT

A crime prevention display device is disclosed which includes a casing (21) provided therein with a chuck mechanism (20) for gripping a wire (W) inserted therethrough, a crime prevention alarm circuit (3) connected to the casing and a load detection means (40, 66, 25) for detecting a variation in load applied from an exhibit to the device. The load detection means (40) detects that removal of the exhibit held on the display device causes the device to be unloaded, so that the crime prevention alarm circuit (3) generates an alarm, leading to warning of the abnormality. Also, the crime prevention alarm circuit (3) generates an alarm sound, which is then collected by a sound wave receiver, followed by inputting of the alarm sound to a centralized control equipment (13), so that it may positively exhibit a crime prevention alarm function without causing any malfunction.

10 Claims, 24 Drawing Sheets

CRIME PREVENTION DISPLAY DEVICE, EXHIBIT CRIME PREVENTION ALARM CONTROL METHOD AND APPARATUS THEREFOR

This is a division of prior application Ser. No. 08/335,734, filed on Nov. 9, 1994, for a CRIME PREVENTION DISPLAY DEVICE, EXHIBIT CRIME PREVENTION ALARM CONTROL METHOD AND APPARATUS THEREFOR now U.S. Pat. No. 5,638,049.

DESCRIPTION

1. Technical Field

This invention relates to an exhibit or display device equipped with a crime prevention equipment (hereinafter also referred to as "crime prevention display device") which is used for exhibiting or displaying an interior or exterior decoration such as a picture, a sculpture, a craftwork, a panel or the like, and a burglarproof or theftproof method for controlling crime prevention and alarm for an exhibit (hereinafter also referred to as "exhibit crime prevention alarm control method") and an apparatus therefor.

2. Background Art

In general, it is known to employ a crime prevention system in an art museum or any other exhibition hall to ensure theft prevention and safety management of a picture or any other article of value when it is exhibited therein. Such a conventional crime prevention system is typically constructed in combination with generation of an alarm and/or watching by a guard. For the purpose of night maintenance and management of security, it is widely employed to secure locking-up management of a building. Also, an alarm network for detecting opening of a door or a window or a control system by a radio wave is widely employed as well.

Unfortunately, the conventional control systems described above each are insufficient to prevent theft of an exhibit. Also, the control system utilizing transmission of a radio wave not only causes the control to be troublesome due to regulation on outputting of a radio wave but frequently causes malfunction due to radio hindrance or radio interference, resulting in bringing about troubles due to wrong information and adversely affecting post-management. Also, it causes facilities for the control to be expensive, to thereby be unsuitable for simple exhibition or display. Further, it is insufficient to prevent an exhibit such as a picture or the like from being stolen during exhibition or display. In addition, watching by a guard fails to provide a satisfactory antitheft effect. Thus, the prior art renders maintenance and management of security highly troublesome and fails to provide satisfactory security or safety.

The present invention has been made in view of the foregoing disadvantages of the prior art and an object of the present invention is to provide a crime prevention display device, an exhibit crime prevention alarm control method and an apparatus therefor which are capable of preventing an individual article or exhibit from being stolen and ensuring satisfactory maintenance and management of security free of any wrong information while exhibiting an economical advantage.

Another object of the present invention is to provide a display device which is capable of permitting suspension, stretching and tightening of an exhibit suspension wire to be readily and rapidly accomplished, positively detecting holding and removal of an article with respect to the device, and safely and positively accomplishing suspension of the article.

DISCLOSURE OF INVENTION

In accordance with one aspect of the present invention, a crime prevention display device is provided. The display device comprises a casing provided therein with a chuck mechanism for gripping a wire inserted therethrough, a crime prevention alarm circuit, and a load detection means connected to the crime prevention alarm circuit and arranged for detecting a variation in load applied from an exhibit thereto. In the crime prevention display device thus constructed, the load detection means detects a variation in load when the exhibit is removed from the display device, to thereby actuate the crime prevention alarm circuit, leading to warning of the abnormality by alarm display by a buzzer or the like.

In accordance with another aspect of the present invention, an exhibit crime prevention alarm control method is provided. The method comprises the steps of generating an alarm sound due to removal of an exhibit from a display device, collecting the alarm sound to obtain a sound wave signal, converting the sound wave signal into a pulse signal by means of an A/D conversion circuit, removing signal components other than those having frequencies within a predetermined range centering around a frequency of a particular sound wave from the pulse signal by means of a digital filter, and inputting the pulse signal to a time filter to detect continuous generation of a particular sound wave signal for a predetermined period of time or more, so that an alarm circuit is actuated to generate an alarm signal, resulting in a centralized control being carried out.

In accordance with a further aspect of the present invention, an exhibit and display crime prevention alarm apparatus is provided. The apparatus comprises a display device including a chuck mechanism for gripping a wire inserted therethrough and provided with an alarm generating circuit for generating a sound wave of a predetermined frequency; and a receiver including a microphone for collecting the sound wave generated from the alarm generating circuit and converting it into an electrical signal, an amplification circuit for amplifying the electrical signal fed from the microphone thereto, an analog filter including an A/D conversion circuit for selecting a desired signal component from the amplified signal and converting it into a pulse signal, a digital filter for excluding a particular sound wave component from the pulse signal, and a time filter for distinguishing a digital signal from a false signal. The receiver is provided with an alarm circuit for generating an alarm signal.

When an exhibit such as a picture or the like is set on the crime prevention display device in an art museum or any other exhibition hall, removal or movement of the picture causes an alarm signal generating circuit provided on the display device to generate a particular sound wave signal, which is then collected by a microphone and separated from a noise and a false signal. Then, the sound wave signal is fed to a centralized control chamber and stored therein, to thereby actuate the alarm circuit, resulting in warning of the abnormality. Thus, the present invention effectively accomplishes antitheft of an article of value such as a picture exhibited or the like and management of security.

DETAILED DESCRIPTION OF THE PREFERRED EMBODIMENTS

Figure 1:
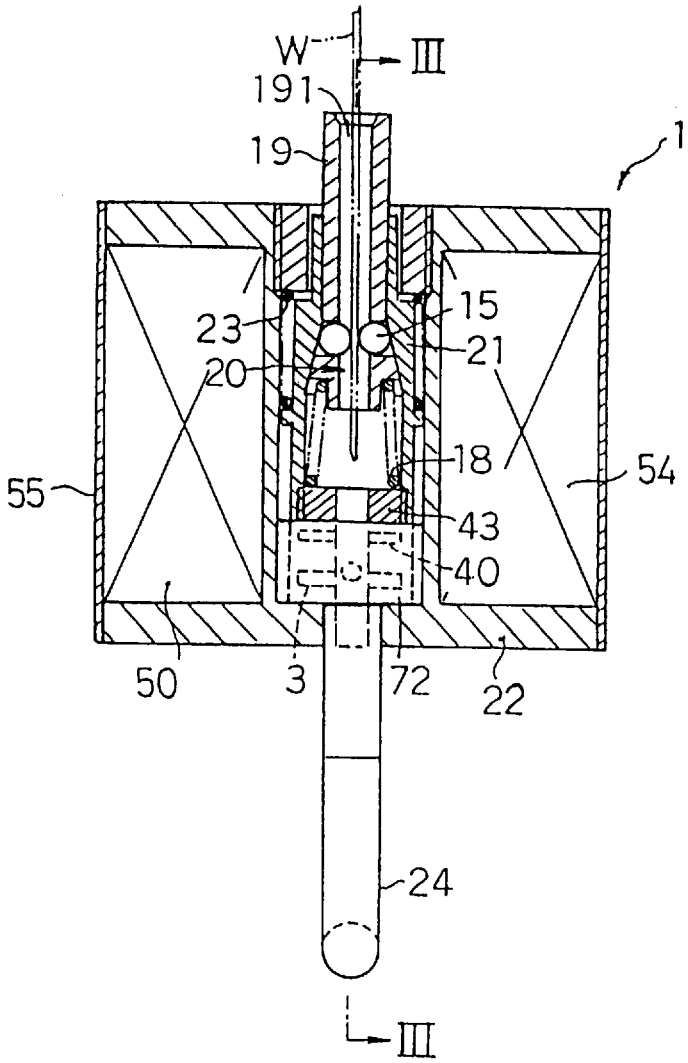
FIG. 1 is a front elevation view in section taken along line I—I of FIG. 2 which shows a suspension device equipped with a crime prevention equipment (hereinafter also referred to as "crime prevention suspension device") which is an embodiment of a crime prevention display device according to the present invention.

Now, the present invention will be more detailedly described hereinafter with reference to the accompanying drawings.

Referring first to FIGS. 1 to 6, a suspension device equipped with a crime prevention equipment or a crime prevention suspension device which is a first embodiment of a crime prevention display device according to the present invention is illustrated. A crime prevention suspension device of the first embodiment which is designated at reference numeral 1 generally includes a casing 21 including a chuck mechanism 20 for selectively gripping a wire W inserted therethrough and a holder 22 in which the casing 21 is received in a manner to be vertically slidable. The holder 22 is threadedly mounted thereon with a hook 24. Also, the holder 22 is provided therein with a shell 72 so as to be positioned below the casing 21, in which shell a crime prevention alarm circuit 3 and a semiconductor pressure sensitive sensor 40 connected to the circuit 3 are received. The casing 21 is downwardly urged by a spring 23, so that a lower end of the casing 21 pressedly forces the semiconductor pressure sensitive sensor 40 by means of force depending on load acting on the hook 24 of the holder 22. The semiconductor pressure sensitive sensor 40 is actuated in a compressed manner between the holder 22 and the casing 21 by vertical load acting on the hook 24 and connected through a conductive wire 45 to a bridge circuit of the crime prevention alarm circuit 3 arranged on a printed circuit board 44.

Figure 2:
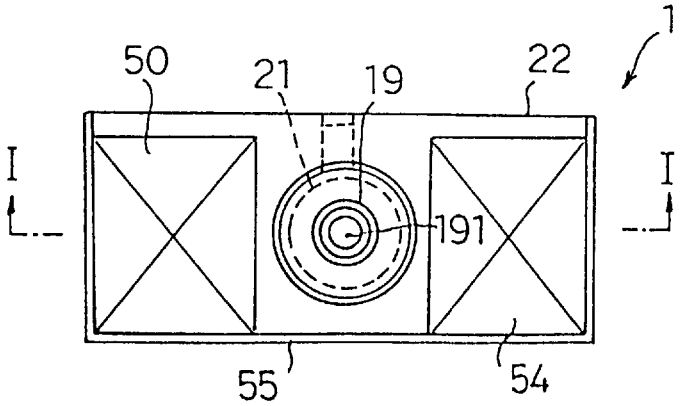
FIG. 2 is a plan view of the suspension device shown in FIG. 1.
Figure 3:
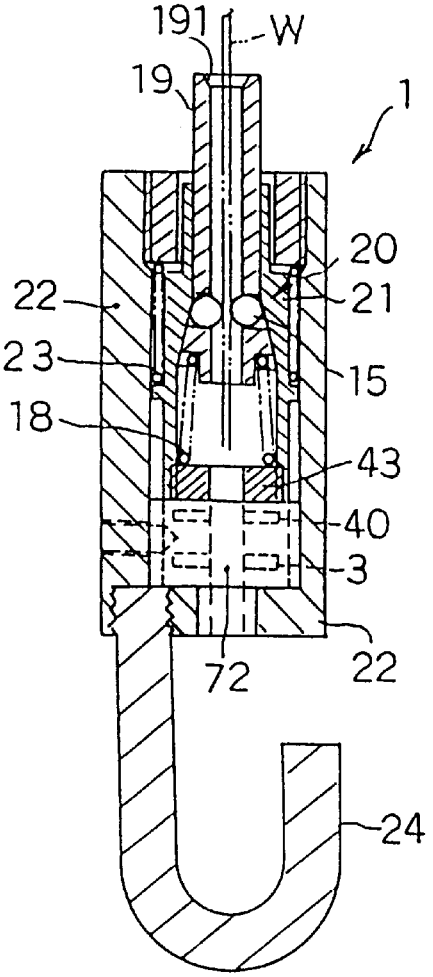
FIG. 3 is a vertical sectional view taken along line III—III of FIG. 1.

As shown in FIGS. 1 to 3, the casing 21 is formed into a hollow cylindrical shape and has an inner surface of which one end portion is tapered so as to act as an abutment surface. The casing 21 includes an inner pin 19 formed with a wire insertion through-hole 191 via which the wire W led out of the casing 21 is guided.

The inner pin 19 is adapted to hold therein at least two balls 15 and is held in the casing 21 so as to be freely movable in an axial direction of the casing 21, resulting in constituting the chuck mechanism 20. In the illustrated embodiment, three such balls 15 are held in the inner pin 19. The inner pin 19 comprises a pipe-like member formed with the wire insertion hole 191 so that the wire W is outwardly axially inserted between the balls 15 and is formed on an outer periphery of a central portion thereof with a frust-conical section so as to be fitted in the inner tapered surface of the casing 21. The frust-conical section is formed with three ball insertion holes, in which the balls 15 are arranged, respectively. Movement of the inner pin 19 in the axial direction with respect to the casing 21 causes the balls 15 to be regulated by the inner tapered surface of the casing 21, so that the balls 15 may be accessible to the wire W to selectively carry out gripping and slippage of the wire W. The inner pin 19 has one end portion provided in a manner to be contiguous to an end of the frust-conical section on a small diameter side thereof and projectable from the casing 21. The inner pin 19 is engaged at the other end thereof with a spring 18 encapsulated in the casing 21 by means of a spring seat 43 fixed in an end of the casing 21, resulting in being urged in a direction in which the frust-conical section is fittedly abutted against the tapered inner surface of the casing 21.

Figure 6:
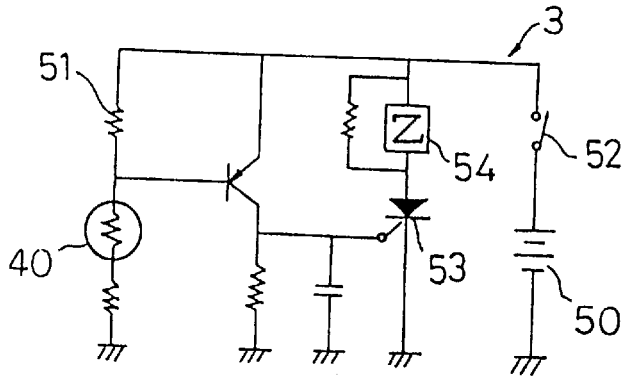
FIG. 6 is an electric circuit diagram showing an alarm circuit for the suspension device shown in FIG. 1.

The crime prevention alarm circuit 3 includes a battery 50, a switch 52, a thyristor 53, a buzzer 54 and a resister 51 as shown in FIG. 6 and main components of the circuit 3 are incorporated in the printed circuit board 44. The crime prevention alarm circuit 3 thus constructed is arranged in the holder 22.

The battery 50 and buzzer 54 are arranged in the holder 22 in a manner to be positioned on both sides of the casing 21 and then surrounded with a cover 55. On-off operation of the switch 52 is carried out by means of a pin inwardly inserted through a small hole (not shown) formed through the cover 55 so as to be set at the time when the crime prevention suspension device is set up, so that turning-off of the switch 52 is rendered highly difficult once actuation of the buzzer starts. Alternatively, an alarm lamp (not shown) may be substituted for the buzzer 54.

Figure 4A:
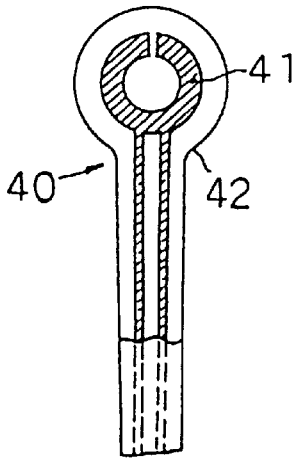
FIG. 4(*a*) is a plan view showing an example of a pressure sensitive sensor used for the suspension device shown in FIG. 1 and FIG. 4(*b*) is a plan view showing another example of the pressure sensitive sensor of FIG. 4(*a*)
Figure 4B:
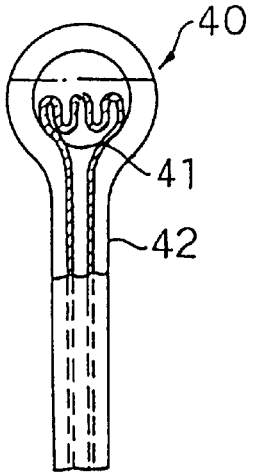

The semiconductor pressure sensitive sensor 40 comprises a film-like pressure sensitive sensor made by arranging a conductive wire element 41 in an insulating sheet 42 as shown in FIG. 4(*a*) or 4(*b*) and acting as a switch. For example, it may comprise a pressure sensor of the resistance variation type which is decreased in resistance value with an increase in pressure applied to an active area thereof. Thus, such a film-like pressure sensitive sensor has output characteristics substantially inversely proportional to a pressure applied thereto and permits breaking force to be set within a range which allows a relationship between force and a resistance value to be between 1MΩ and 50 to 100KΩ. Use of a current-voltage converter circuit or any other suitable interface circuit permits a voltage output substantially proportional to a conductance of the pressure sensitive sensor to be provided.

Figure 5:
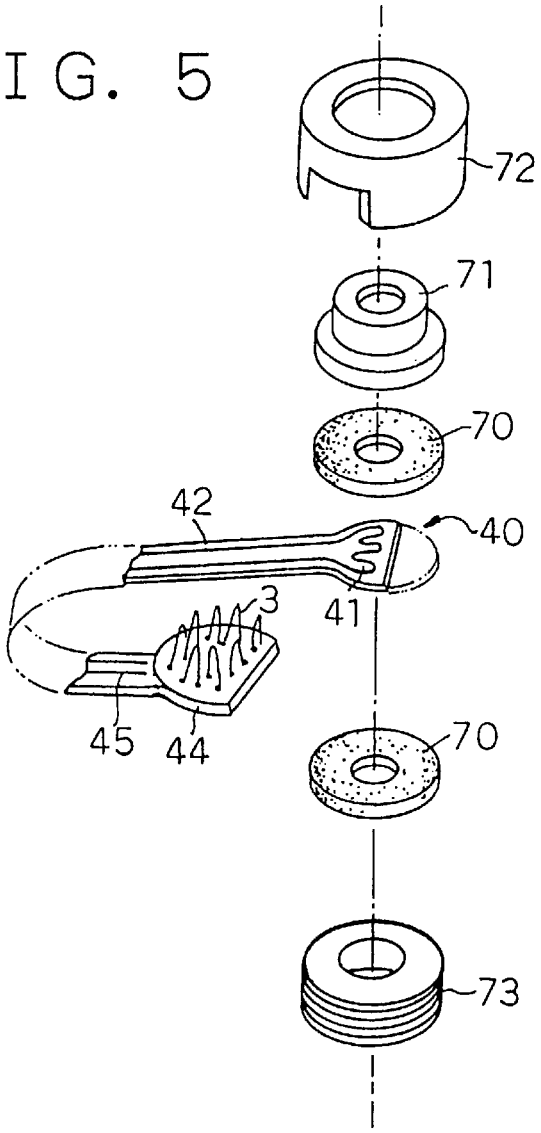
FIG. 5 is an exploded perspective view showing a detection section used in the suspension device shown in FIG. 1.

Also, as shown in FIG. 5, a pair of silicone rubber plates 70 are arranged on both sides of the pressure sensitive sensor 40 to ensure uniform distribution of force and received in a shell 72 while being interposedly supported between a press plate 71 and a support plate 73. The support plate 73 is threadedly fixed in the shell 72. The press plate 71 is arranged in such a manner that one end thereof is upwardly projected through a central opening of the shell 72 so as to be pressedly contacted with the casing 21, to thereby actuate the pressure sensitive sensor 40. Further, the elastic plate 70 for equally distributing force is interposedly arranged between an end surface of the casing 21 defined in a direction of sliding thereof and the semiconductor pressure sensitive sensor 40. The pressure sensitive sensor thus assembled is arranged in the holder 22, to thereby provide the crime prevention suspension device.

The pressure sensitive sensor 40 may be replaced with any suitable means such as a load cell, a strain gauge, a magnet detecting sensor, a photo interrupter, a micro switch or the like.

For operation of the crime prevention suspension device 1 thus constructed, the wire W is fixed to a mount on a wall or the like and then inserted at one end thereof through the casing 21. This leads to opening of the chuck mechanism 20, to thereby permit the suspension device to be movable on the wire W, so that stopping of the suspension device at a predetermined position on the wire W while keeping it suspended from the wire causes the chuck mechanism 20 to be tightened by weight of the suspension device, resulting in the suspension device being fixed on the wire W. Then, when a desired article or exhibit such as a picture is held on the hook 24, load is applied from the article to the suspension device, so that the chuck mechanism 20 firmly grips the wire W, to thereby permit the article to be exhibited while being suspended from the wire W through the suspension device. This causes load to be applied from the article to the suspension device, so that the casing 21 is held in the holder 22 due to compression of the spring 23, to thereby prevent load from being applied to the semiconductor pressure sensitive sensor 40. When the article suspended from the suspension device is removed therefrom for theft, the spring 23 causes the holder 22 to be upwardly slid with respect to the casing 21, so that the semiconductor pressure sensitive sensor 40 is forcedly pressed by the casing 21, resulting in a resistance value of the semiconductor pressure sensitive sensor 40 being varied due to load applied from the casing 21 thereto. Such a variation in resistance value causes the crime prevention alarm circuit 3 to be actuated to cause the buzzer 54 to generate an alarm sound, leading to warning of the abnormality.

Figure 7:
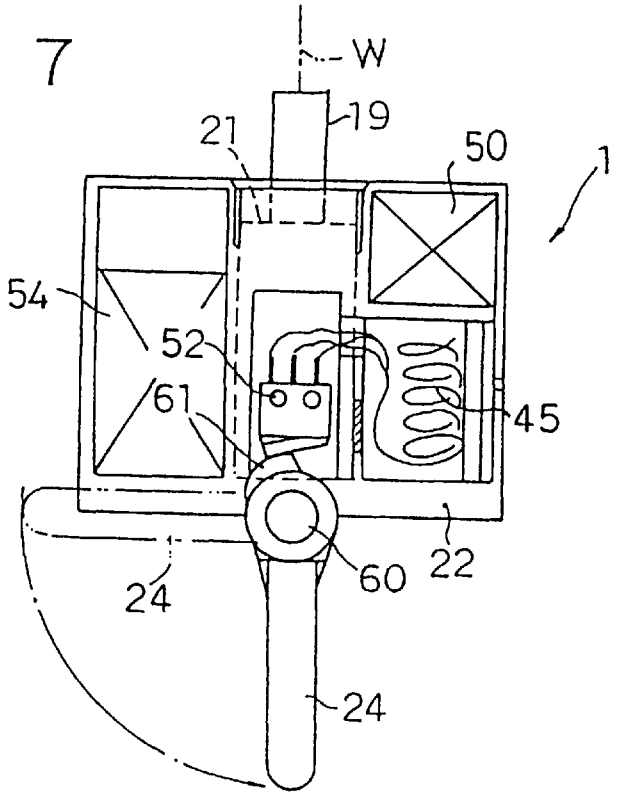
FIG. 7 is a front elevation view partly in section showing a crime prevention suspension device which is another embodiment of a crime prevention display device according to the present invention.
Figure 8:
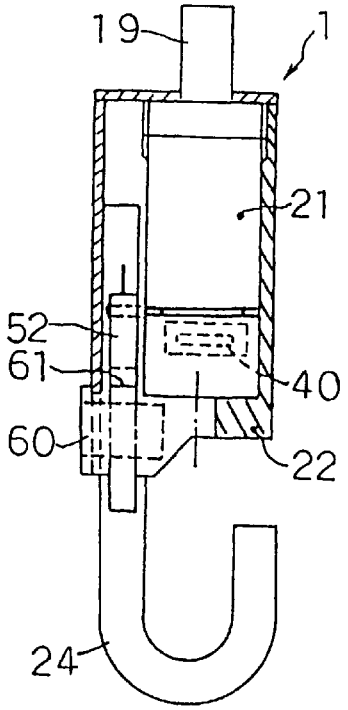
FIG. 8 is a sectional side elevation view of the suspension device shown in FIG. 7.

Referring now to FIGS. 7 and 8, another embodiment of a crime prevention display device according to the present invention is illustrated, which is likewise in the form of a crime prevention suspension device. In the illustrated embodiment, a hook 24 is pivotally connected to a casing 21 at a pivotal connection 60, so that the hook 24 is pivotally or rotatably supported on the casing 21. Also, the hook 24 is provided thereon with a cam section 61 in a manner to be opposite to a setting switch section such as, for example, a micro switch 52. The switch section 52 is connected to a crime prevention alarm circuit 3 including a semiconductor pressure sensitive sensor 40 and forcedly pressed by the cam section 61 when the hook 24 is moved to a vertical position, resulting in being turned on. When the hook 24 is in a position other than the vertical position, the switch section 52 is kept turned off. An alarm circuit board 44 on which the semiconductor pressure sensitive sensor 40 is mounted is mounted thereon with a battery 50 and a buzzer 54 and then arranged in a holder 22. Then, it is surrounded with a cover, resulting in providing a suspension device which is substantially kept from being affected by a temperature.

The illustrated embodiment is so constructed that the suspension devices each are provided with the alarm unit as in the embodiment described above with reference to FIGS. 1 to 6, thus, it may be set in any desired place.

Figure 9:
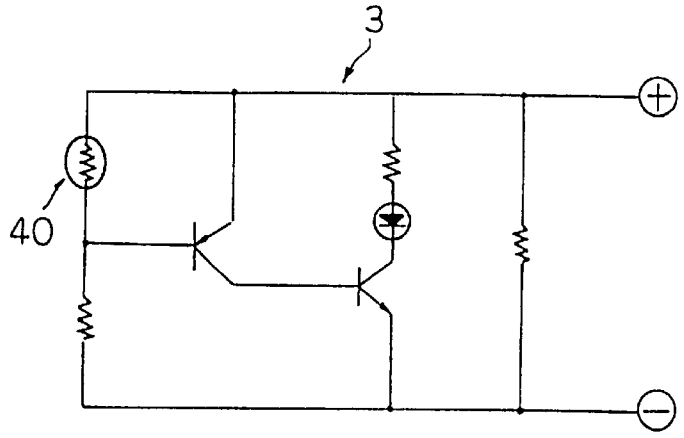
FIG. 9 is an electric circuit diagram showing another example of an alarm circuit.
Figure 10:
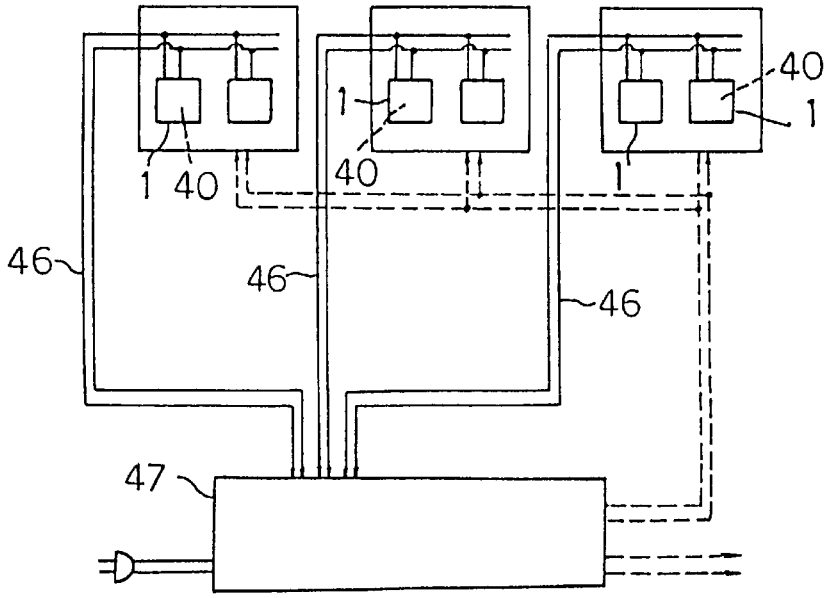
FIG. 10 is a systematic view showing a centralized control system.

Referring now to FIGS. 9 and 10, a centralized control system for crime prevention is illustrated, which is constructed so as to divide the suspension devices 1 constructed as described above into groups and connect the crime prevention circuits 3 on which the pressure sensitive sensors 40 of the suspension devices are arranged in parallel to a bus 46 for every group, so that the circuits 3 are connected through the buses 46 to a centralized control circuit 47. The suspension devices 1 each function as a satellite equipment which acts to input information such as a variation in load applied to the wire W, breakage in the satellite equipment, cutting of the bus, short-circuiting of the bus or the like to the centralized control circuit 47, to thereby concurrently carry out lighting of a group identification lamp and control of actuation of an alarm output such as an output of a buzzer, an output of a disaster prevention system, an output of a subscriber's telephone or the like. This results in the centralized control system readily and positively identifying which suspension device has been burglarized.

Figure 11:
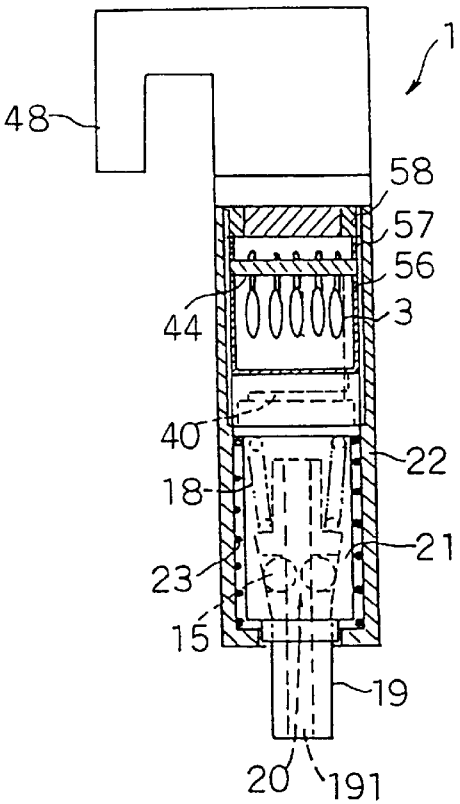
FIG. 11 is a vertical sectional view showing a crime prevention suspension device which is a further embodiment of a crime prevention display device according to the present invention.
Figure 12:
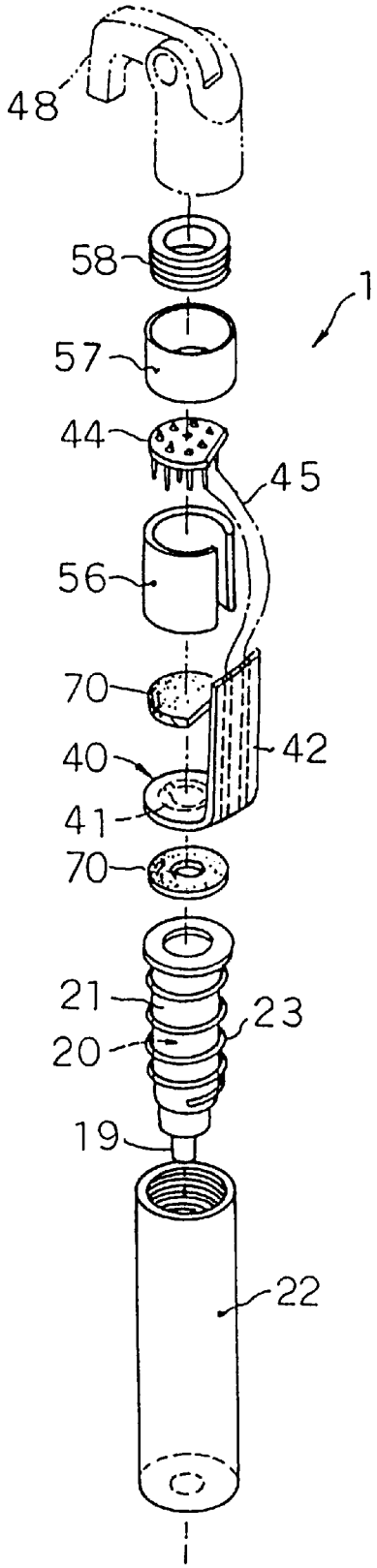
FIG. 12 is an exploded perspective view of the suspension device shown in FIG. 11.

In this instance, a power supply and the buzzer may be provided on a side of a meter equipment for centralized control. Therefore, the suspension device 1 may be constructed in such a manner as shown in FIGS. 11 and 12, which illustrates a further embodiment of a crime prevention display device according to the present invention. More particularly, a crime prevention suspension device shown in FIGS. 11 and 12 is so constructed that a holding hook 48 is threadedly engaged with a holder 22 of a circular or rectangular cylindrical shape and all components including a casing 21, a spring 23, a semiconductor pressure sensitive sensor 40 and the like are provided together with collars 56 and 57 and a fixing screw 58 in the holder 22.

Figure 13:
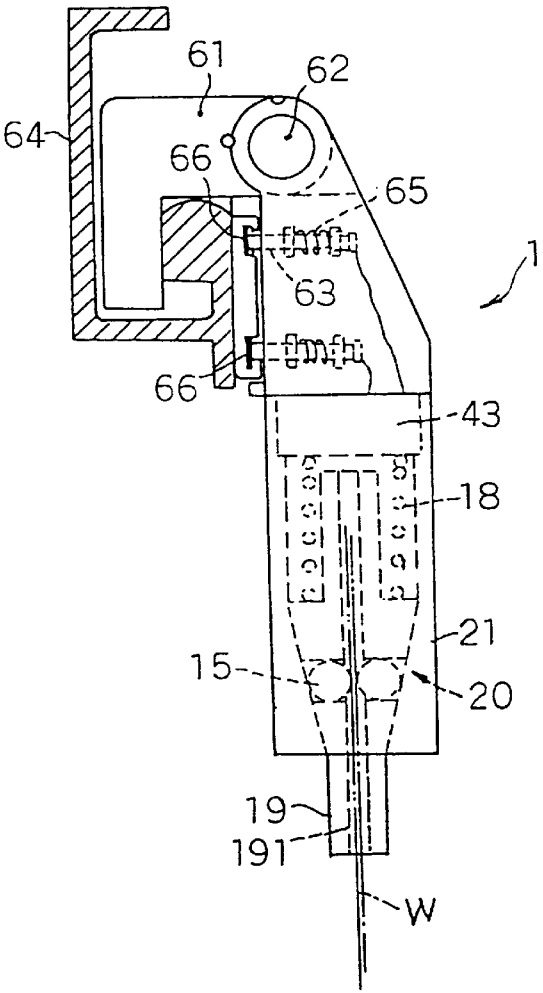
FIG. 13 is a side elevation view partly in section showing a crime prevention suspension device which is still another embodiment of a crime prevention display device according to the present invention.
Figure 14:
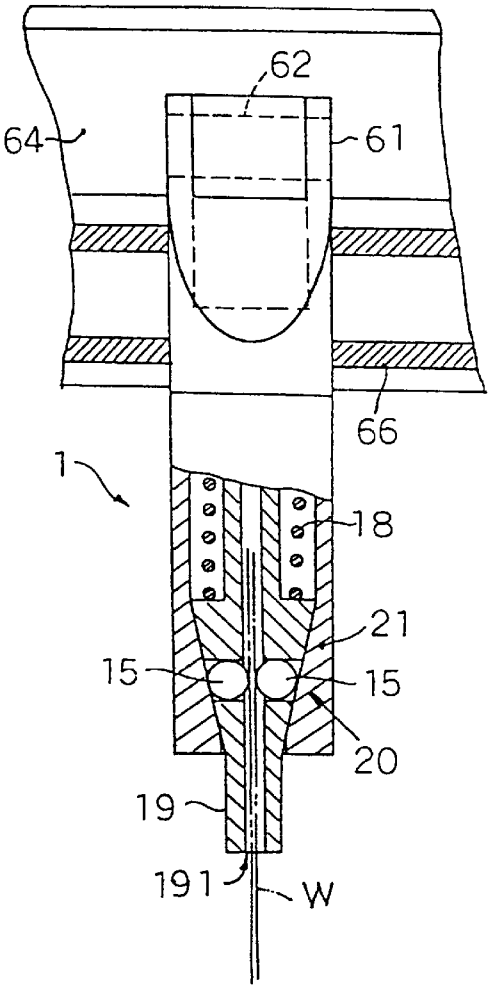
FIG. 14 is a front elevation view partly in section of the suspension device shown in FIG. 13.

Referring now to FIGS. 13 and 14, still another embodiment of a crime prevention display device according to the present invention is illustrated, which is likewise in the form of a crime prevention suspension device. In a crime prevention suspension device of the illustrated embodiment, a casing 21 provided with a chuck mechanism 20 is engagedly put on a rail 64 and a holding hook 61 is joined to the casing 21 through a pivotal connection 62. Between the rail 64 and the holding hook 61 is arranged a semiconductor pressure sensitive sensor 66 in a manner to be opposite to a rod 63 urged by a spring 65. Force acting on the semiconductor pressure sensitive sensor 66 about the pivotal connection 62 is detected, so that crime prevention is controlled by a crime prevention alarm system. The chuck mechanism 20 for wire gripping is constituted by cooperation of the casing 21, an inner pin 19 and balls 15, to thereby permit a wire W to be interposedly held between the balls 15 by means of a spring 18, resulting in the suspension device being suspended from the wire W as in each of the above-described embodiments.

Figure 15:
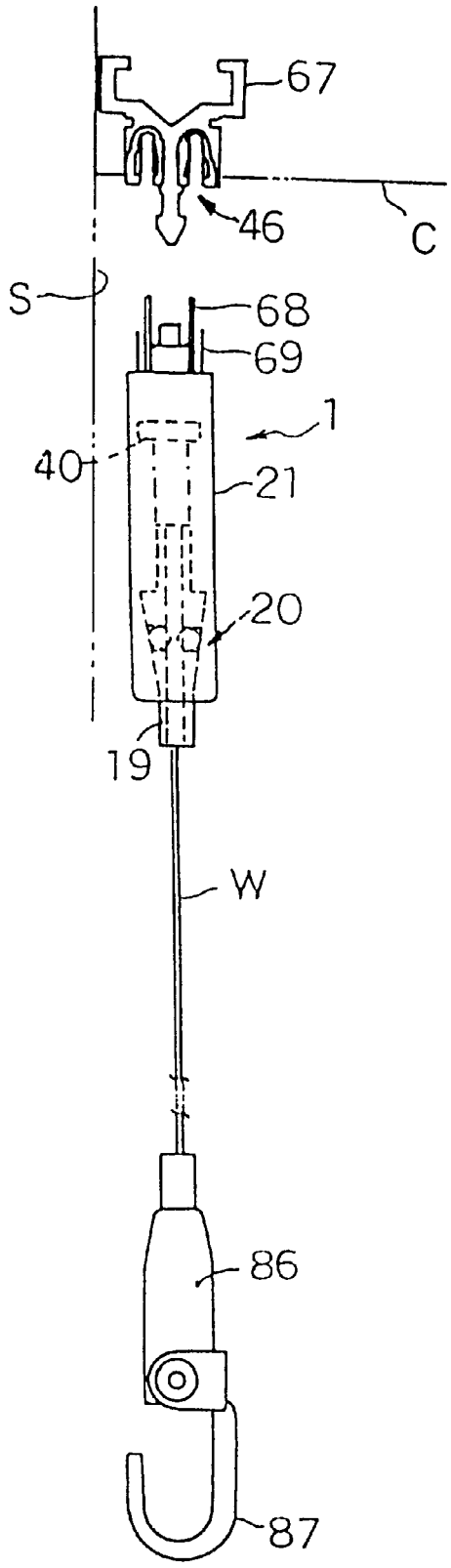
FIG. 15 is a side elevation view showing the manner of operation of another example of a centralized control system.
Figure 16:
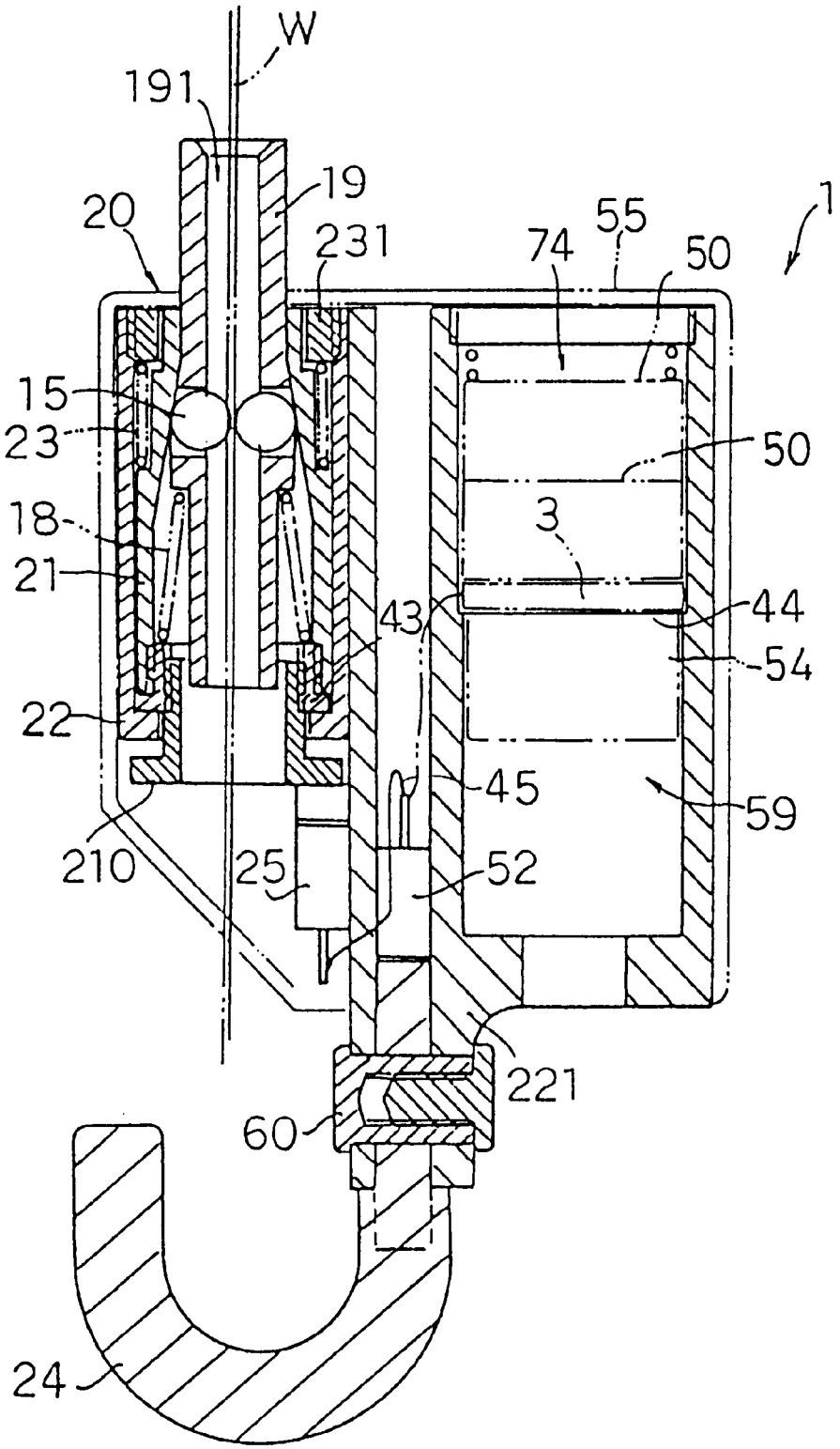
FIG. 16 is an enlarged vertical sectional view taken along line XVI—XVI of FIG. 17 which shows a crime prevention suspension device which is yet another embodiment of a crime prevention display device according to the present invention.
Figure 17:
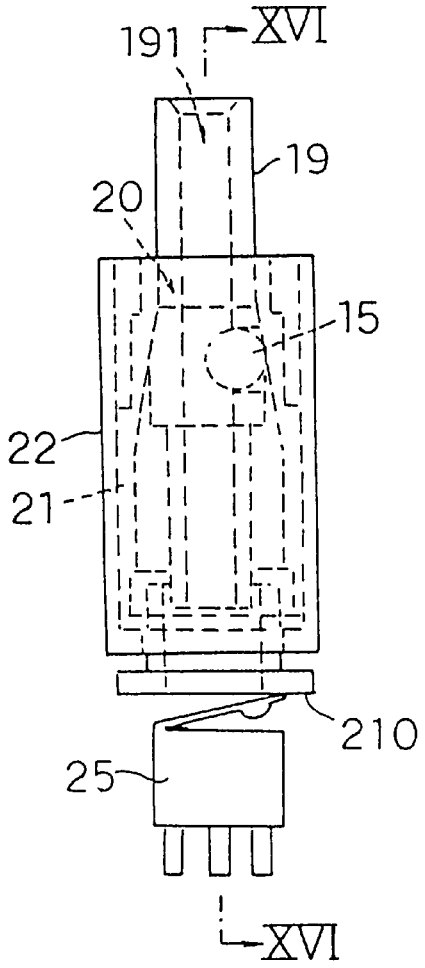
FIG. 17 is a front elevation view showing a part of the suspension device of FIG. 16.
Figure 18:
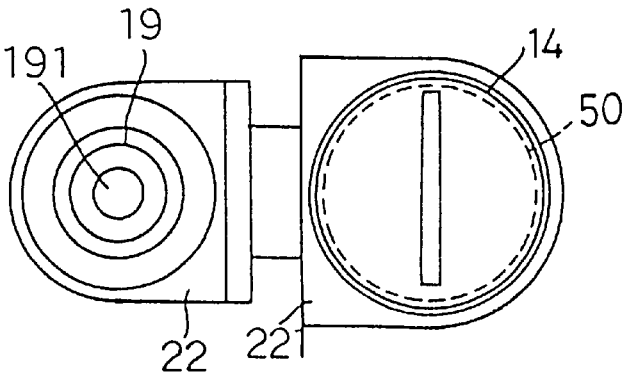
FIG. 18 is a plan view of the suspension device shown in FIG. 16.
Figure 19:
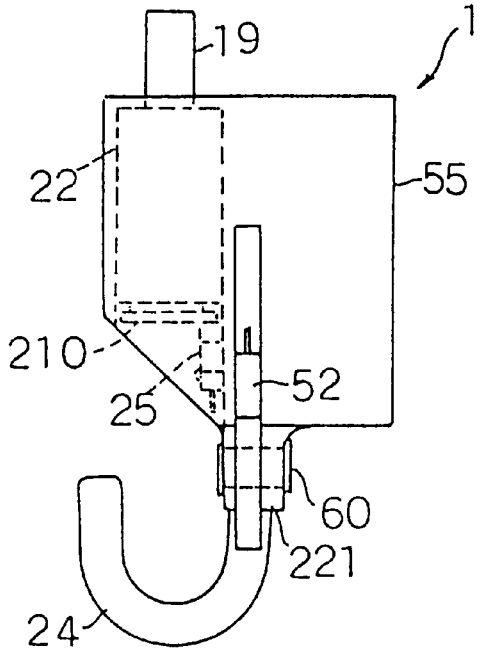
FIG. 19 is a side elevation view of the suspension device shown in FIG. 16.
Figure 20:
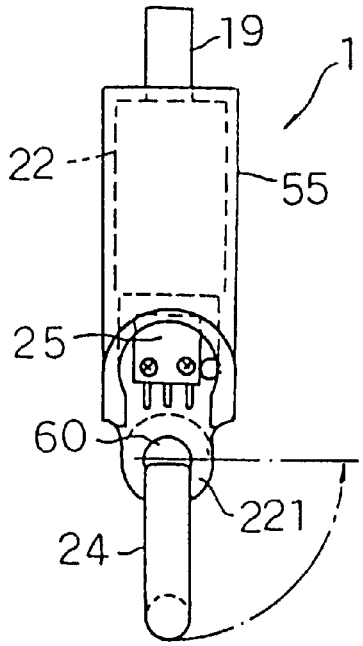
FIG. 20 is a front elevation view of the suspension device shown in FIG. 16.

Referring now to FIG. 15, yet another embodiment of a crime prevention display device according to the present invention is illustrated, which is likewise in the form of a crime prevention suspension device. In the illustrated embodiment, a ceiling C or a wall S is mounted thereon with a rail 67, in which a sensor bus 46 is incorporated. A suspension device 1 includes a casing 21 provided with a sensor plug 68 and an attachment 69, as well as a chuck mechanism 20 and a semiconductor pressure sensitive sensor 40 arranged in the casing 21, resulting in being accommodated to system control. In the illustrated embodiment, a hook 87 including a grip mechanism 86 is preferably mounted on an end of a wire W.

Referring now to FIGS. 16 to 21, even another embodiment of a crime prevention display device according to the present invention is illustrated, which is likewise in the form of a crime prevention suspension device. In the illustrated embodiment, a casing 21 including a chuck mechanism 20 is slidably arranged in a holder 22 and the holder 22 is provided with a hook 24. Also, a micro switch 25 is arranged so as to be opposite and contiguous to one end 210 of the casing 21 and connected together with a power switch 52 to a crime prevention alarm circuit 3, to thereby provide a crime prevention suspension device 1.

In the illustrated embodiment, the holder 22 is mounted on one side thereof with a hook mounting member 221, which is then pivotally mounted with the hook 24 through a support shaft 60. Also, the micro switch 25 is adapted to make an action in correspondence to vertical load acting on the hook 24 and abutted against the one end 210 of the casing 21 while being opposite thereto. Also, the micro switch 25 is connected together with a power switch 52 through a conductive wire 45 to a printed circuit board 44 having the crime prevention alarm circuit 3 mounted thereon, to thereby be connected to both a battery 50 and a buzzer 54.

The casing 21 is threadedly fitted therein with an adjustment member which serves to adjust abutment between the one end 210 of the casing 21 and the micro switch 25 opposite thereto.

Figure 21:
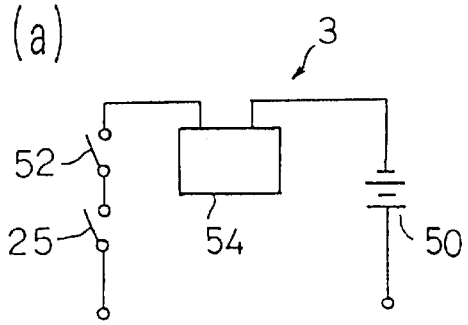
FIG. 21(*a*) is an electric circuit diagram showing an example of an alarm circuit for the suspension device of FIG. 16 and FIG. 21(*b*) is an electric circuit diagram showing another example of the alarm circuit shown in FIG. 21(*a*)
Figure 21:
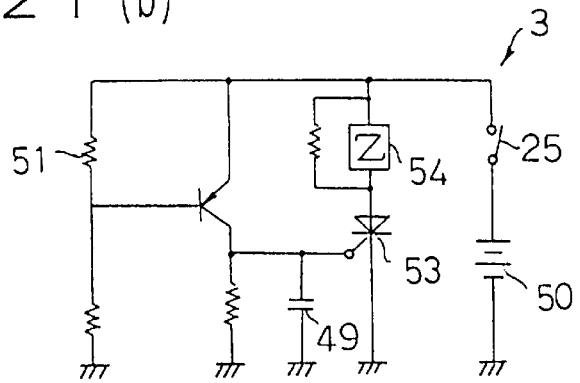

The crime prevention alarm circuit 3 may have respective single circuits of the battery 50, power switch 52, micro switch 25 and buzzer 54 incorporated therein as shown in FIG. 21(*a*). Alternatively, it may be an alarm circuit 3 comprising the battery 50, the micro switch 25, a thyristor 53, the buzzer 54 and a resistor 51 as shown in FIG. 21(*b*). The crime prevention alarm circuit 3 is incorporated in the printed circuit board 44 and arranged in the hook mounting member 221.

Also, as in the embodiment shown in FIGS. 7 and 8, the illustrated embodiment may be preferably constructed in such a manner that a micro switch is used as the power switch 52 and arranged in so as to be abutted against the hook 24 pivotally mounted on the hook mounting member 221 through the support shaft 60, resulting in being turned off when the hook 24 is moved to a horizontal position and turned on when it is moved to a vertical position. Also, the hook mounting member 221 includes a housing 59, which has the battery 50 and buzzer housed therein and entirely surround with a cover 55, so that turning-off of the buzzer 54 is rendered difficult once it is turned on due to actuation of the micro switch 25. Resetting of the buzzer thus turned off to turning-on may be carried out through a separate operation. Alternatively, an alarm lamp (not shown) may be substituted for the buzzer 54 or combined with the buzzer.

In the drawings, reference numeral 14 designates a cap detachably mounted on a battery storage section 74. 231 is a presser lid detachably fitted in a casing receiving section 75. 49 is a capacitor.

The suspension device of the illustrated embodiment thus constructed is fixed at a predetermined position on a wire W inserted therethrough and an article or exhibit is held on the hook 24, so that chuck mechanism 20 firmly grips the wire W, resulting in the article being suspended from the suspension device. This causes load to be applied from the article to the suspension device, so that the casing 21 is held in the holder 22 due to compression of the spring 23, to thereby prevent load from being applied to the semiconductor pressure sensitive sensor 40. When the article suspended from the suspension device is removed from the hook 24 of the suspension device 1 for theft, the spring 23 causes the holder 22 including the hook 24 to be upwardly slid with respect to the casing 21, so that the micro switch 25 is forcedly pressed by the casing 21, resulting in being closed. This actuates the crime prevention alarm circuit 3 to permit a current to flow from the battery 50 to the buzzer 54, resulting in the buzzer 54 generating a warning sound, leading to warning of the abnormality.

In the illustrated embodiment, the suspension devices each are provided with the alarm unit, to thereby be applicable to any desired place. Alternatively, a plurality of the suspension devices of the illustrated embodiment may be used for a centralized control system for crime prevention in a manner similar to FIG. 10. In this instance, the holder 22 of each of the suspension devices is not provided with the battery 50 and buzzer 54 and generation of alarm is carried out by operating the micro switch 25.

Figure 22:
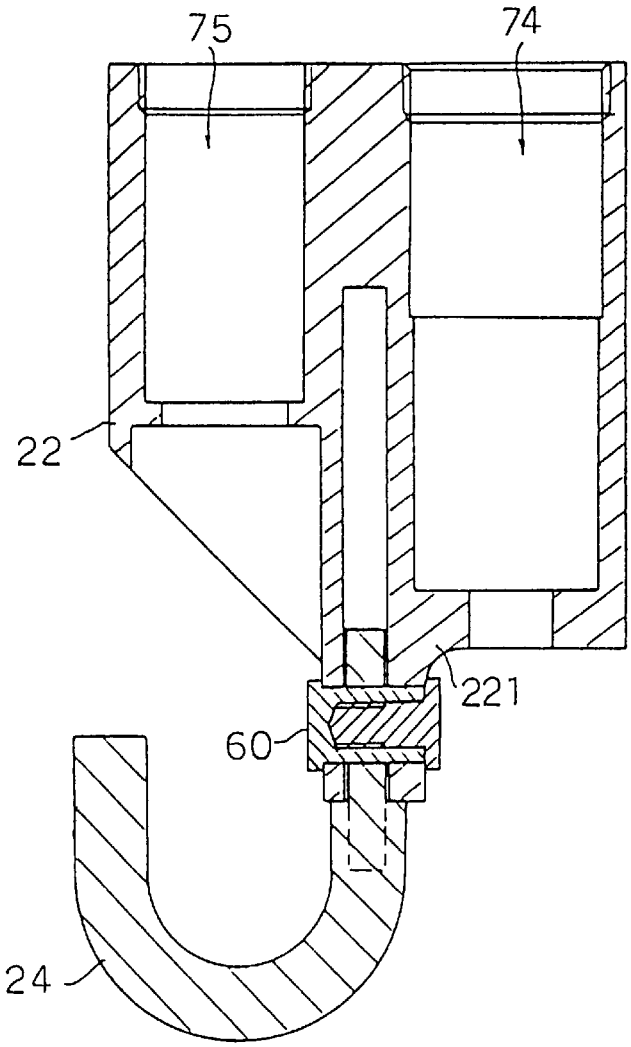
FIG. 22 is an enlarged front elevation view in section showing a part of a modification of the suspension device of FIG. 16.
Figure 23:
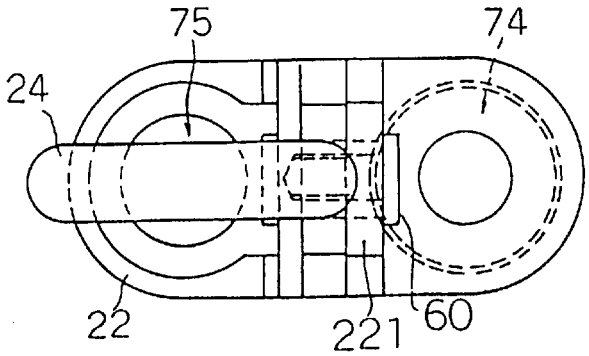
FIG. 23 is a bottom view of the suspension device shown in FIG. 22.

Referring now to FIGS. 22 and 23, a further embodiment of a crime prevention display device according to the present invention is illustrated, which is likewise in the form of a crime prevention suspension device. In a crime prevention suspension device of the illustrated embodiment, a holder 22 and a hook mounting member 221 are formed in a manner to be integral with each other and a casing receiving section 75 for receiving a casing 21 therein and a storage section 74 for storing a battery 50 and a buzzer 54 therein are provided. A member like the cover 55 described above may be eliminated from the suspension device of the illustrated embodiment.

Figure 24:
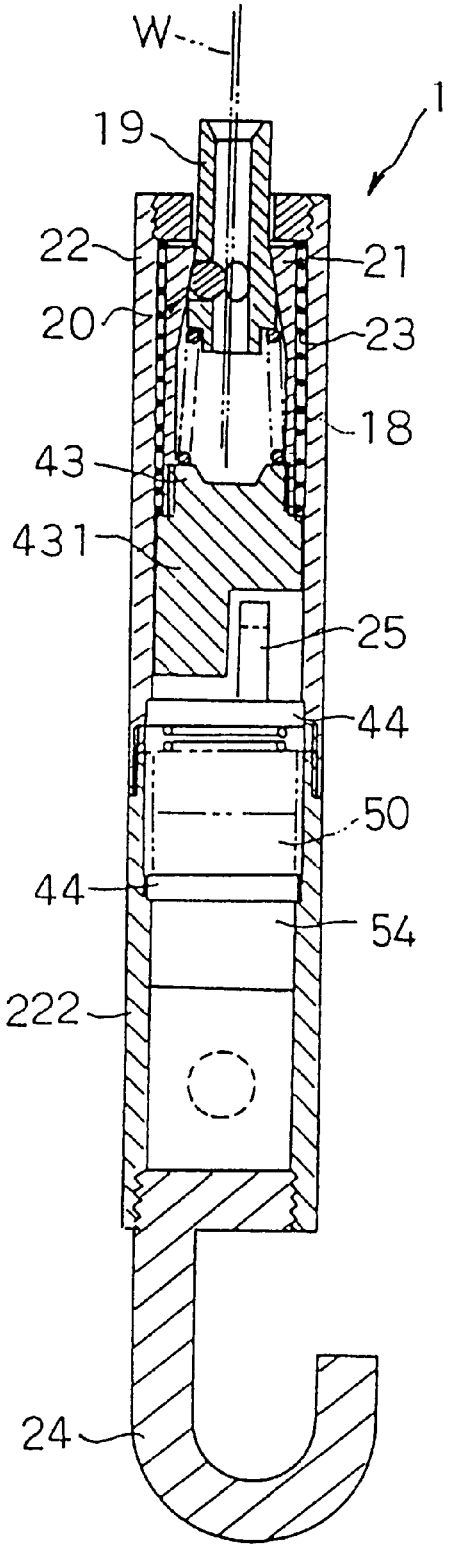
FIG. 24 is an enlarged vertical sectional view showing a crime prevention suspension device which is even another embodiment of a crime prevention display device according to the present invention.
Figure 26:
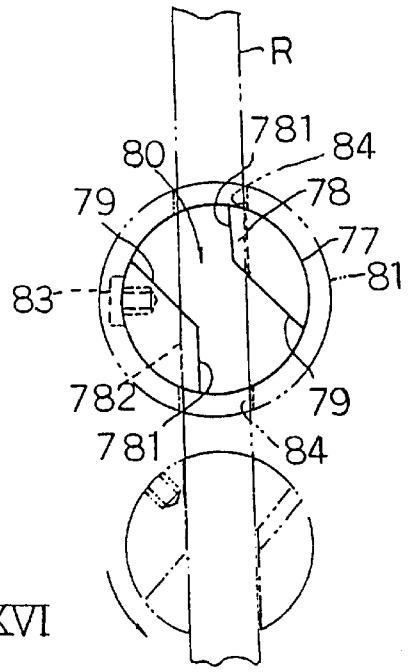
FIG. 26 is an enlarged plan view taken along line XXVI—XXVI of FIG. 25.
Figure 25:
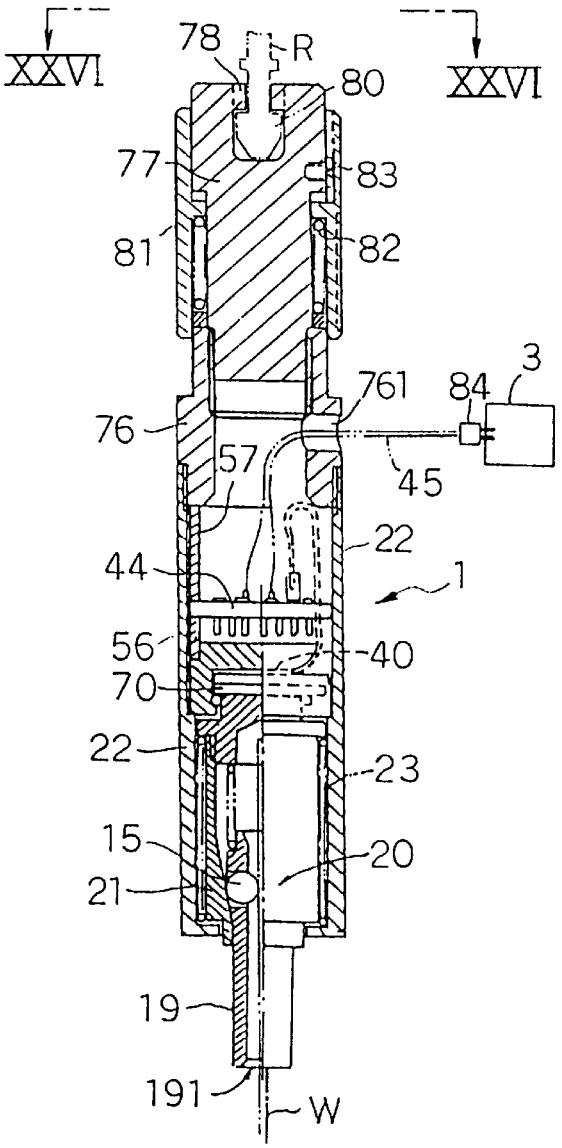
FIG. 25 is a sectional front elevation view showing a crime prevention suspension device which is another embodiment of a crime prevention display device according to the present invention.
Figure 27:
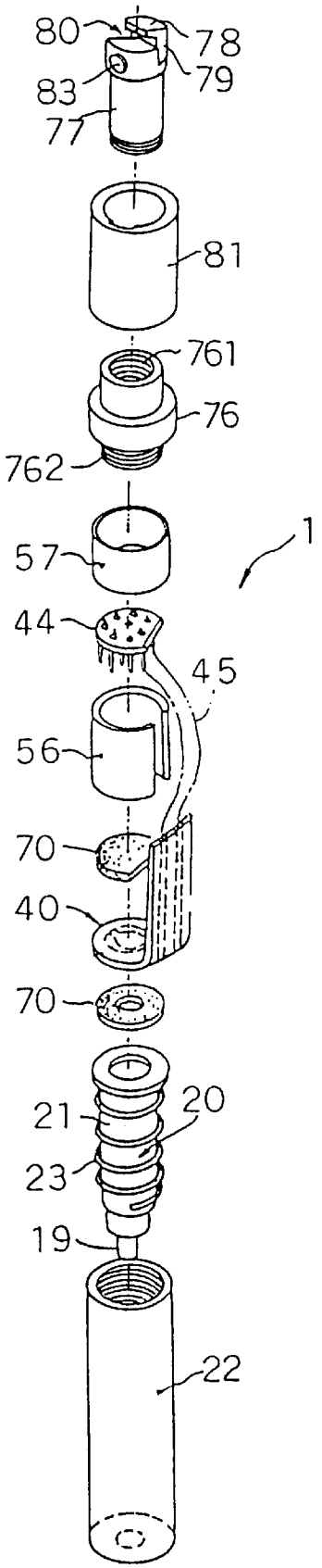
FIG. 27 is an exploded perspective view of the suspension device shown in FIG. 25.
Figure 28:
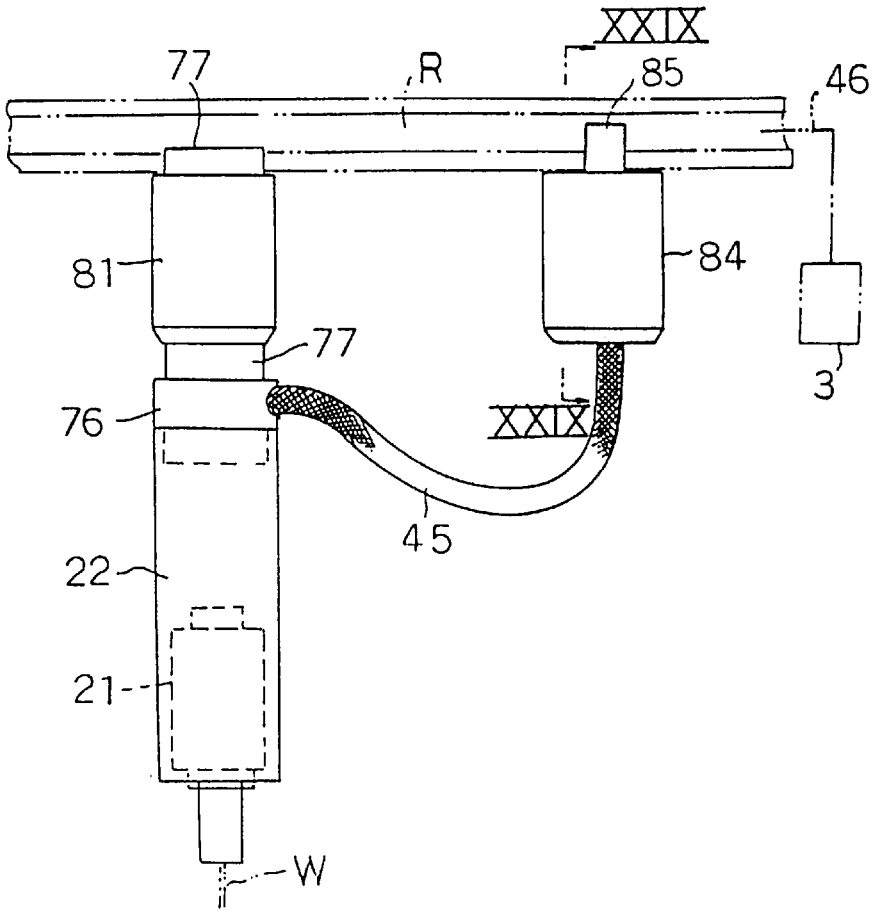
FIG. 28 is a side elevation view showing the manner of operation of the suspension device of FIG. 25.
Figure 29:
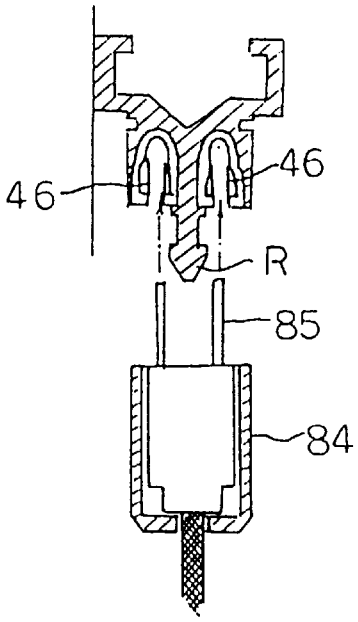
FIG. 29 is a fragmentary front elevation view in section taken along line XXIX—XXIX of FIG. 28.

FIG. 24 shows a still further embodiment of a crime prevention display device according to the present invention, which is likewise in the form of a crime prevention suspension device. A crime prevention suspension device of the illustrated embodiment is constructed into a vertical structure, wherein a holder 22 is threadedly mounted at a lower end thereof with a hook mounting member 222 and a casing 21 includes an inner pin 19 urged by a spring 23 and provided at a lower end thereof with a spring seat 13. The spring seat 13 is provided with a slide member 431 so as to be projected therefrom. The slide member 431 is arranged in a manner to be slidable and opposite to a micro switch 25. The hook mounting member 222 is provided therein with a circuit board 44, a battery 50 and a buzzer 54 and fixedly mounted at a lowermost end thereof with a hook 24.

Referring now to FIGS. 25 to 29, a yet further embodiment of a crime prevention display device according to the present invention is illustrated, which is likewise in the form of a crime prevention suspension device. In a suspension device of the illustrated embodiment, a casing 21 includes a chuck mechanism 20 adapted to grip a wire W inserted therethrough and is slidably received in a holder 22. The holder 22 is mounted on an upper end thereof with an engagement joint 76 through which a grip member 77 is fixed on the upper end of the holder 22. The grip member 77 is formed at an upper end thereof with a recessed groove 80 for rail insertion, which is provided therein with a pair of holding pawls 78, 78 opposite to each other in a point-symmetric manner, as well as a pair of rail insertion surfaces 79, 79 opposite to each other in a point-symmetric manner. The grip member 77 is threadedly fixed in the engagement joint 76 and is fitted on an outer periphery thereof with a mounting cylinder 81 in a slidable manner. The cylinder 81 is urged in one direction by a spring 82 and is prevented from rotating by means of a rotation stopper 83 such as, for example, a screw, a key or the like. The mounting cylinder 81 is formed at an upper end thereof with cutouts 84, 84, which are fitted on a lower portion of a rail R when the grip member 77 is mounted on the rail R, resulting in cooperating with the rotation stopper 83 to prevent the grip member 77 from being rotated by the spring 82.

The recessed groove 80 in which the rail R is fitted is so formed that the rail insertion surfaces 79, 79 defining a first groove section formed into a width which permits the lower portion of the rail to be inserted thereinto and fit surfaces 781, 781 defining a second groove section formed into a width which permits a neck portion of the rail to be fitted therein intersect with each other at a position in proximity to a center of the recessed groove 80, respectively. The fit surfaces 781, 781 of the second groove section are formed with holding recesses 782, 782 in which the lower portion of the rail is fitted, to thereby provide the above-described holding pawls 78, 78, respectively.

The holder 22 is provided therein with a semiconductor pressure sensitive sensor 40 in a manner to be opposite to an inner end surface thereof defined in a direction of sliding thereof through a distribution member 70 for equally distributing force. The semiconductor pressure sensitive sensor 40 is connected through a conductive wire 45 to a board 44 on which a bridge circuit is arranged so that it operates when it detects removal of a suspended article from the suspension device based on a variation in load applied thereto, resulting in alarm display being carried out through a crime prevention alarm circuit 3. This realizes centralized safety control for warning and monitoring.

The engagement joint 76 in which the grip member 77 is threadedly fitted is formed with a lead-out port 761 from which the conductive wire 45 connected at one end thereof to the semiconductor pressure sensitive sensor 40 and at the other end thereof to an attachment plug 84 including a connection terminal 85 is led out. Alternatively, the holder 22 may be integrally mounted with a cordless attachment plug 84.

Now, the manner of operation of the thus-constructed suspension device of the illustrated embodiment for suspending an article or exhibit such as a picture from the wire W through the suspension device will be described hereinafter. The recessed groove 80 of the grip member 77 provided on one end of the suspension device is pressed against the rail R mounted on a ceiling or a side wall to insert the rail R between the rail insertion surfaces 79 and 79 while downwardly forcing the mounting cylinder 81 against the spring 82. Then, the grip member 77 is rotated about an axis thereof, so that the neck portion of the rail R is interposedly held between the holding pawls 78 and 78 oppositely arranged in the recessed groove 80. Then, the mounting cylinder 81 is forced toward the rail by the spring 82, resulting in the suspension device being fixed on the rail R. Thereafter, the wire W is fitted in the chuck mechanism 20 arranged in the casing 21 and then an article or exhibit is connected through the wire W to the suspension device, resulting in being suspended from the suspension device.

A position of the suspension device can be changed by upwardly pushing the suspension device held on the rail R and sliding the suspension device along the rail R while downwardly pushing the mounting cylinder 81. Then, when an operator's hold is loosed of the suspension device, the mounting cylinder 81 is upwardly pushed, resulting in the suspension device being fixed on the rail. Removal of the suspension device from the rail is carried out in a manner contrary to the above. More particularly, the suspension device is upwardly pushed and the grip member 77 is rotated in a direction opposite to that described above, to thereby relatively move the rail R from the holding pawls 78 toward the rail insertion surfaces 79. Then, the suspension device is downwardly drawn out of the rail. Thus, it will be noted that mounting and releasing of the suspension device with respect to the rail can be readily accomplished by a one-touch operation.

Figure 30:
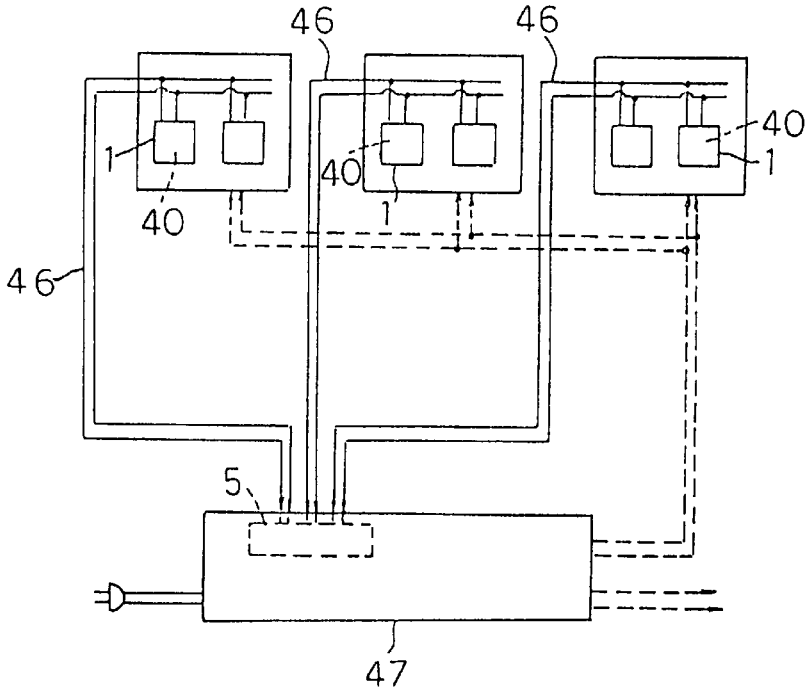
FIG. 30 is a systematic view showing a centralized control system.

A centralized control system for crime prevention using a plurality of the suspension devices of the illustrated embodiment can be realized in a manner as shown in FIG. 30. More particularly, a plurality of the suspension devices 1 which are connected in parallel to each other for every group are connected through a bus 46 to a centralized control circuit 47 including the crime prevention alarm circuit 3. A power supply, a buzzer and the like may be arranged on a side of a centralized control master equipment, therefore, each of the suspension devices acting as a satellite equipment may be so constructed that all components including the casing 21, a spring 23, a semiconductor pressure sensitive sensor 40 and the like are received together with the joint 76 including collars 56 and 57 and a fixing screw 762 in the holder 22 of a circular or rectangular cylindrical shape and the grip member 77 is threadedly fixed in a threaded hole 761 formed through the joint 76.

Figure 31:
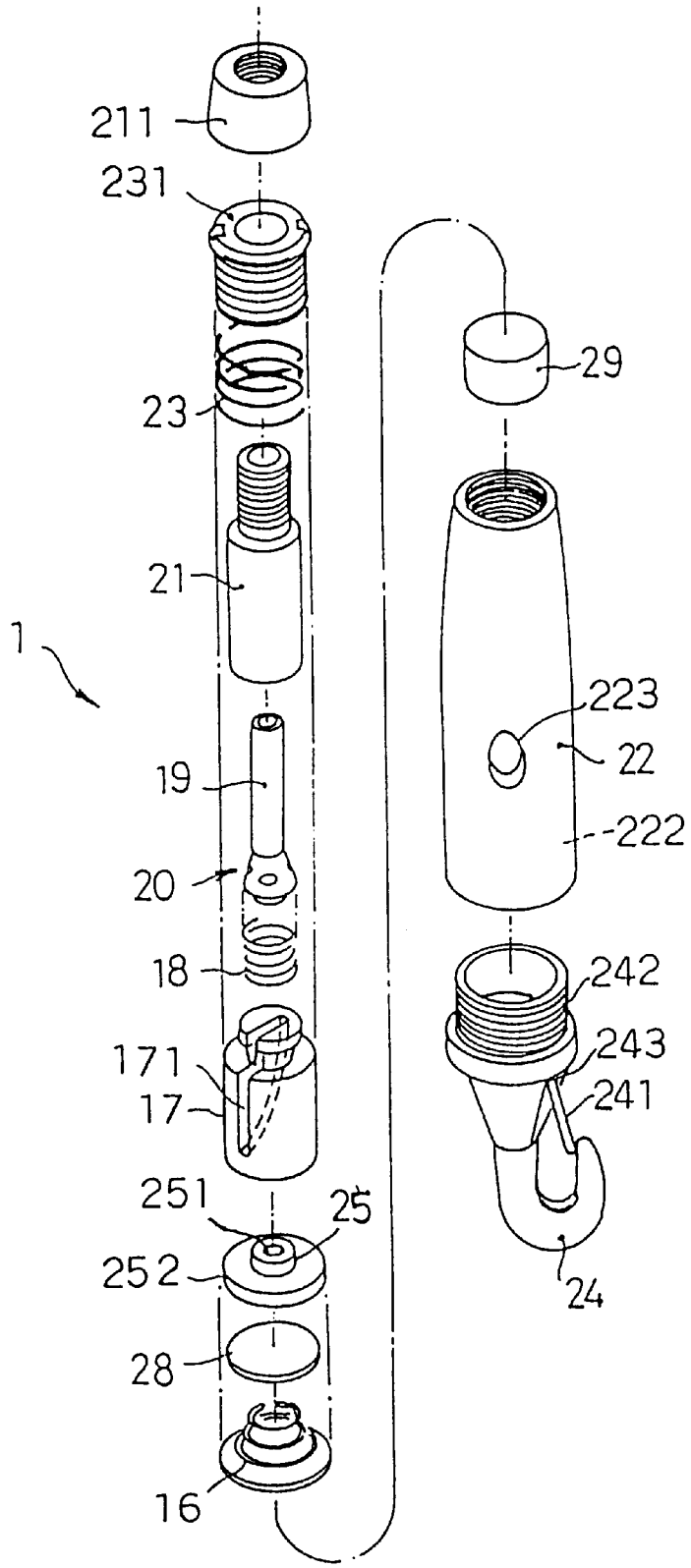
FIG. 31 is an exploded perspective view showing a still further embodiment of a crime prevention display device according to the present invention.
Figure 32:
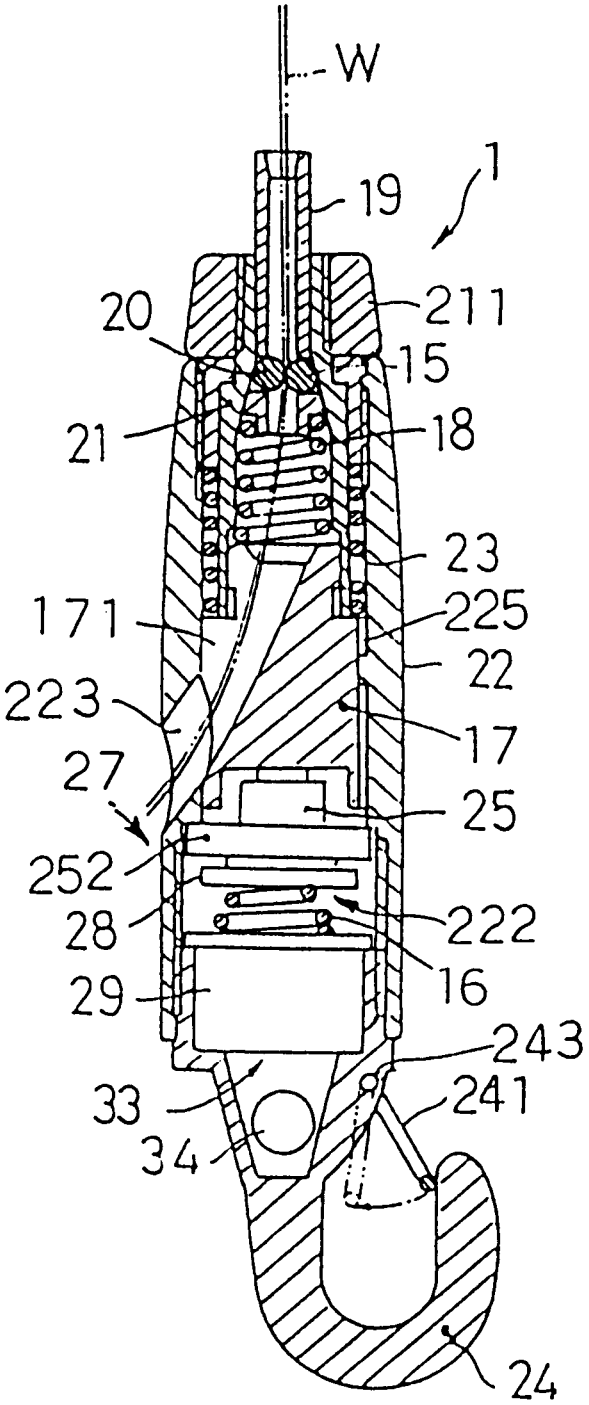
FIG. 32 is an enlarged vertical sectional view showing the manner of operation of the display device of FIG. 31.
Figure 33:
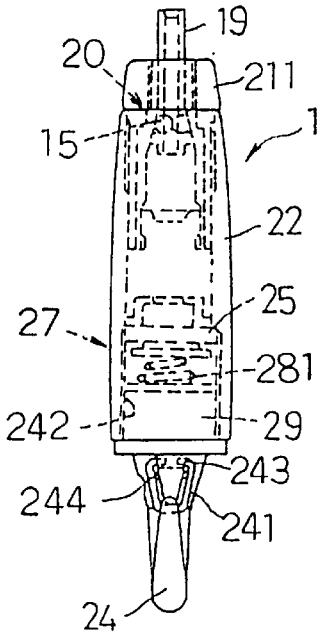
FIG. 33 is a front elevation view of the display device shown in FIG. 32.
Figure 34:
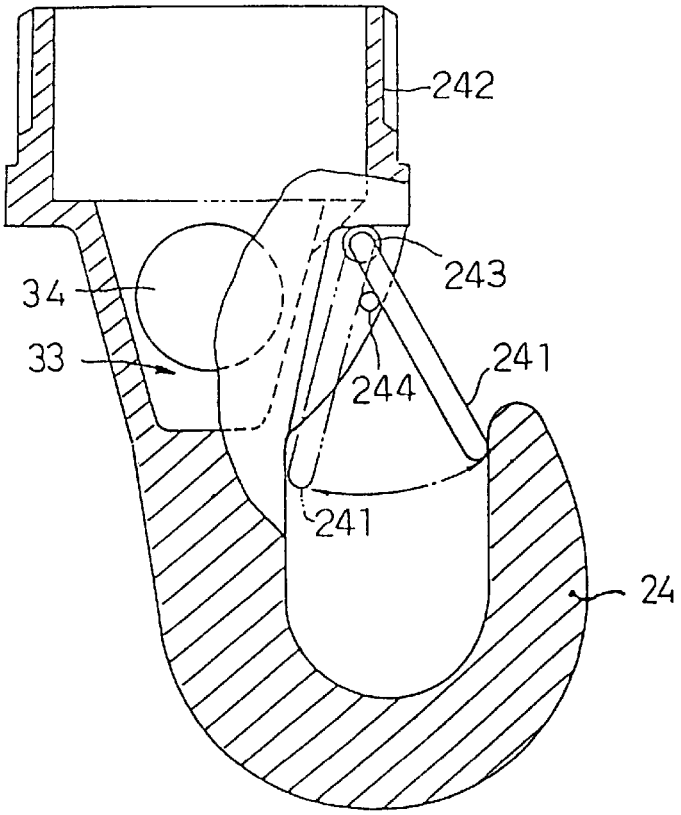
FIG. 34 is a fragmentary enlarged side elevation view in section of the display device shown in FIG. 32.

Referring now to FIGS. 31 to 35, an even further embodiment of a crime prevention display device according to the present invention is illustrated, which is likewise in the form of a crime prevention suspension device. A crime prevention suspension device of the illustrated embodiment includes a hollow cylindrical holder 22 and a casing 21 which includes a chuck mechanism 20 for gripping a wire W while inserting it therethrough and is slidably received in the holder 22 while being urged in one direction by a spring 23. The holder 22 is detachably mounted on a lower end thereof with a hook 24 through a hook mounting section 242 of the hook 24. The hook 24 is pivotally mounted at a support portion 243 thereof with an anti-disconnection lever 241. The lever 241, as shown in FIGS. 33 and 34, may comprise a wire formed into a substantially U-shape of which both ends each are fitted in a hole of the hook 24 so as to serve as a center 243 for pivotal movement of the lever 241. The hook 24 is provided thereon with a mount-like projection 244, so that the lever 241 gets over the projection 244 during pivotal movement thereof about the pivotal center 243, to thereby be held on either one of both sides of the projection 244, resulting in being locked at each of both end positions of the pivotal movement while being kept open or closed. Alternatively, the wire of a substantially U-shape for the lever are fittedly supported at both ends thereof in holes stepwise formed at a body of the hook 24, to thereby be pivotally movable in a stepwise manner, resulting in being automatically restored by elastic force of the lever 241. In this instance, the projection 244 may be eliminated.

Also, the holder 22, as shown in FIGS. 31 and 32, is provided therein with a collar 17 arranged so as to be opposite and contiguous to an end surface of the casing 21 defined in a direction of sliding thereof and acting as a spring bearing, a micro switch 25 including a switch button 251 and a board 252, a battery 28, and a buzzer 29, which are connected together with a power switch 26 to an alarm circuit 27. In the illustrated embodiment, the holder 22 is preferably provided therein with the alarm circuit 27 in which the micro switch 25, the battery 28, a presser spring 16 and the buzzer 29 are detachably incorporated while being interposed between the hook mounting section 242 of the hook 24 and the collar 17 and electrically connected to each other. Alternatively, the battery 28 and presser spring 16 interposed between the micro switch 25 and the buzzer 29 may be arranged in the holder 22 in a manner vertically contrary to that shown in FIG. 32. Also, in the illustrated embodiment, the hook 24 is formed in a manner to be integral with the hook mounting section 242. Alternatively, both may be formed separate from each other. In this instance, the former may be threadedly connected to the latter so as to be detachable from the latter.

The holder 22 is formed at a lower portion thereof with a receiving section 222 for receiving an alarm circuit mechanism therein. Also, the holder 22 is formed at a side wall thereof with a through-hole 223 via which the wire W is drawn out of the holder 22, so that an end of the wire W may be outwardly led out from a slit 171 of the collar 17 arranged in the holder 22 via the through-hole 223. In this instance, the collar 17 and holder 22 are prevented from being rotated relative to each other by means of a key stopper mechanism 225 constituted by a recessed groove or projected groove provided on an outer periphery of the collar 17 so as to vertically extend and a projected groove or recessed groove formed on an inner surface of the holder 22 so as to correspond to the recess of the collar 17, to thereby keep communication between the slit 171 and the through-hole 223, resulting in ensuring that the end of the wire W is smoothly led out via the through-hole 223.

The hook 24 is formed with a through-hole 34 which permits a part of the receiving section 222 of the holder 22 to act as a resonance chamber and the alarm circuit mechanism is received in the receiving section 222, so that operation of the micro switch 25 prevents the buzzer 29 which has been turned on once from being readily turned off. The buzzer may be reset by a resetting operation.

In the drawings, reference numeral 211 designates a mounting cap, which is threadedly fitted on the casing 21, so that the amount of threading of the cap 21 on the casing 21 permits positional adjustment of the casing 21. Reference numeral 231 is an adjustment cap acting also as a stopper for preventing removal of the casing 21. The adjustment cap 231 functions to adjust force of the spring 23 for pressing the micro switch 25. For this purpose, the adjustment cap 231 is threadedly fitted in the upper end of the holder 22, to thereby cooperate with the cap 211 to constitute a mechanical switch.

Figure 35A:
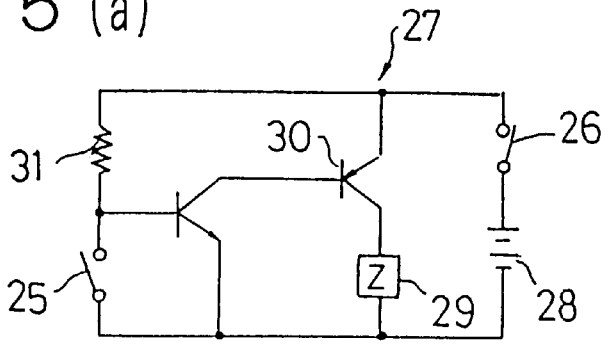
FIG. 35(*a*) is an electric circuit diagram showing an example of an alarm signal generating circuit for the suspension device of FIG. 32 and FIG. 35(*b*) is an electric circuit diagram showing another example of the alarm circuit shown in FIG. 35(*a*)
Figure 35B:
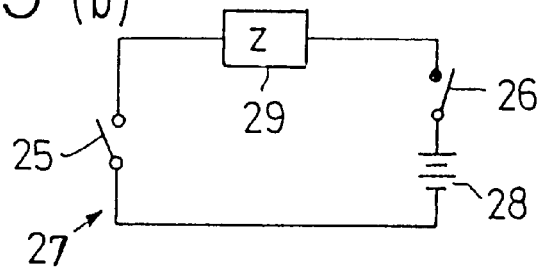

The alarm circuit 27, as shown in FIGS. 35(*a*) and 35(*b*), preferably has a unit circuit incorporated therein which comprises the battery 28, the power switch 26 and micro switch 25, and the buzzer 29. Alternatively, it may be an alarm circuit comprising the battery 28, the micro switch 25, a transistor 30, the buzzer 29 and a resistor 31 and having a contact normally kept turned on and rendered turned off when it operates, as shown in FIG. 35(*a*). Alternatively, the alarm circuit 27 may be so constructed that the contact is normally kept turned off and rendered turned on at the time of operation of the circuit 27, as shown in FIG. 35(*b*). The alarm circuit 27 thus constructed is incorporated in a printed circuit board and then arranged in the holder 22. Further, in view of handling of the suspension device of the illustrated embodiment, it is preferable that the power switch 26 comprises a manually operated switch which is adapted to be closed at a set position of the hook mounting section 242.

In the crime prevention suspension device 1 of the illustrated embodiment thus constructed, when the suspension device is held at a desired position on the wire W inserted therethrough and an article or exhibit 2 is held on the hook 24, the chuck mechanism 20 firmly grips the wire W, resulting in the article 2 being securely suspended from the suspension device. This causes load to be applied from the article to the suspension device, so that the casing 21 is held in the holder 22 due to compression of the spring 23, to thereby prevent load from being applied to the micro switch 25. When the article suspended from the suspension device is removed therefrom for theft, the spring 23 causes the holder 22 to be upwardly slid with respect to the casing 21, to thereby operate or press the switch button 251 of the micro switch 25, so that the switch is closed. This leads to actuation of the crime prevention alarm circuit 27 to permit a current to flow from the battery 28 to the buzzer 29, resulting in the buzzer warning the abnormality.

Figure 36:
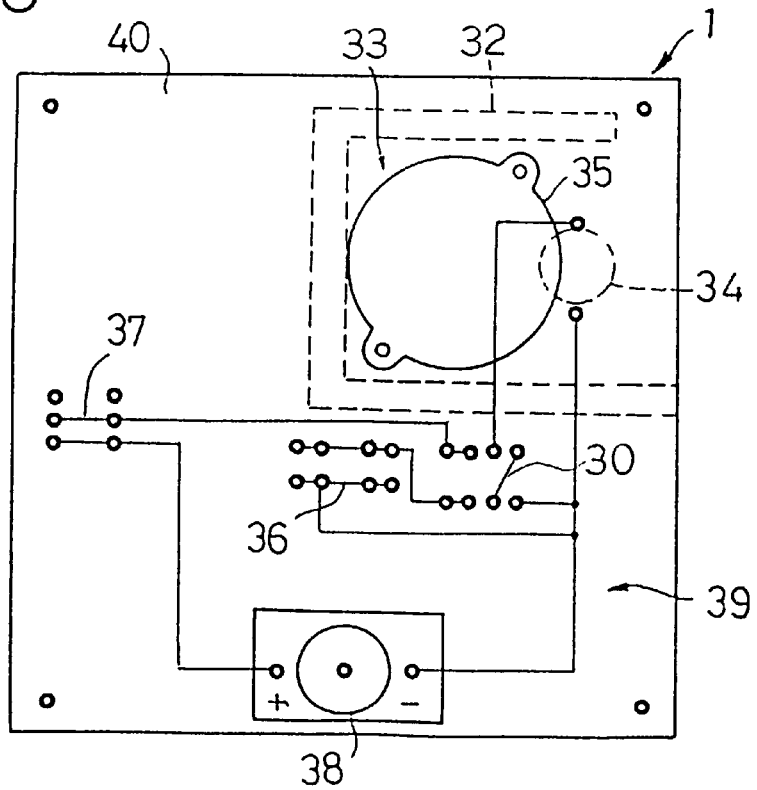
FIG. 36 is a plan view showing a yet further embodiment of a crime prevention display device according to the present invention which is adapted to rest an exhibit thereon.

Referring now to FIG. 36, another embodiment of a crime prevention display device according to the present invention is illustrated, which is constructed in the form of a crime prevention display pedestal adapted to support thereon an article to be exhibited. A crime prevention display device 1 of the illustrated embodiment may include a deflection support surface. Alternatively, it may include a support base 40 arranged so as to be vertically movable. Under the support base 40 is defined a resonance chamber 33 by means of a partition wall 32. Also, a through-hole 34 is formed so as to communicate with the resonance chamber 33, which is provided therein with a buzzer 35. An alarm circuit 39 is provided which includes a transistor 30, a resistor 31, a micro switch 36, a power switch 37 and a battery 38. The micro switch 36 is kept unloaded or open during arrangement of an article or exhibit on the supported base 40, whereas removal of the article from the support base 40 causes the micro switch 36 to be closed, so that the alarm circuit 39 is actuated to turn on the buzzer 35, resulting in an alarm sound being provided therefrom.

The crime prevention display pedestal of the illustrated embodiment is constructed so as to utilize elastic force of a spring of the micro switch 36 during display or exhibition of the article and permit the micro switch 36 to be pressed or closed when the article is removed from the display pedestal.

Figure 37:
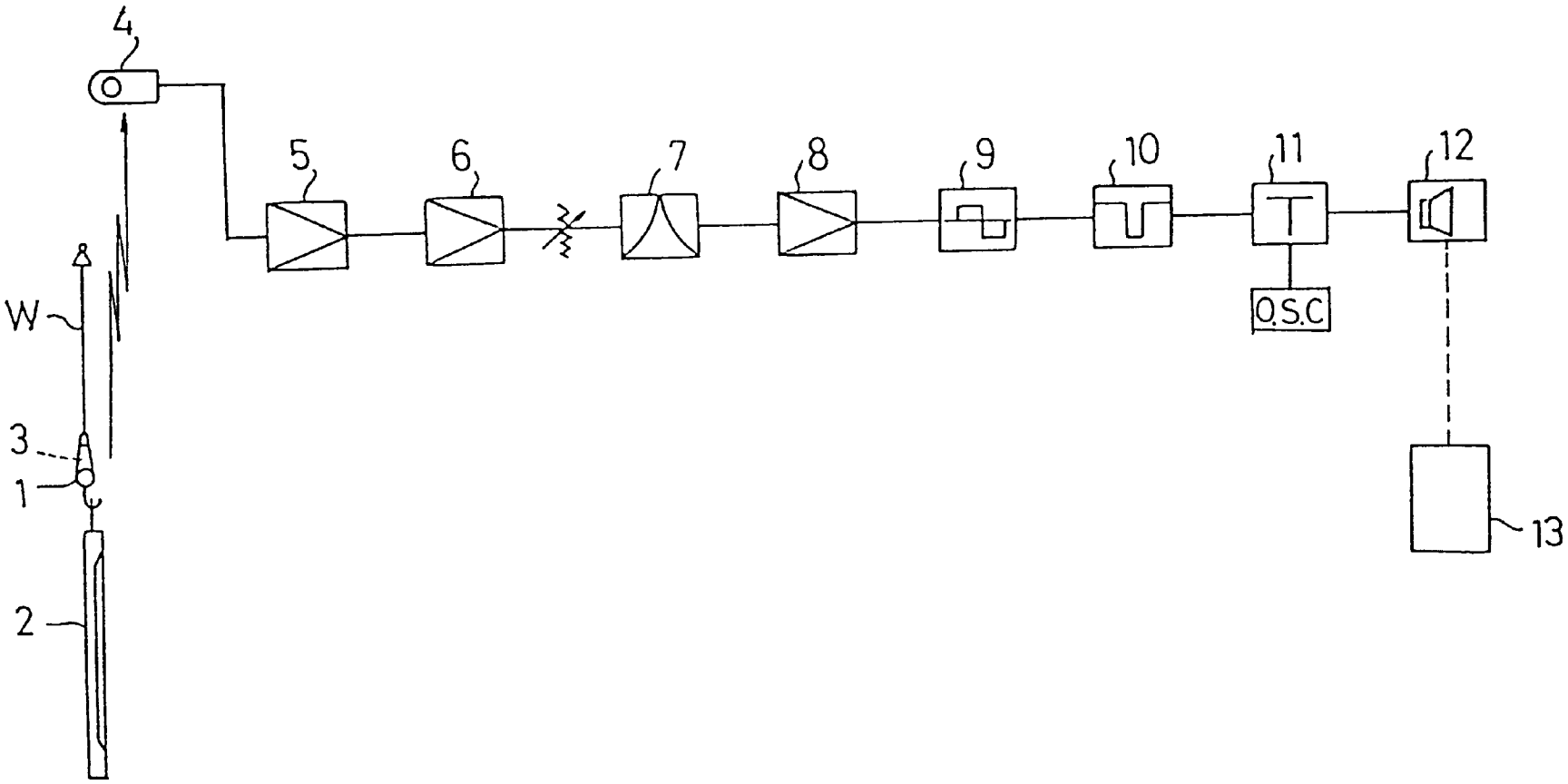
FIG. 37 is a systematic view showing an embodiment of an exhibit crime prevention alarm control method according to the present invention.
Figure 38:
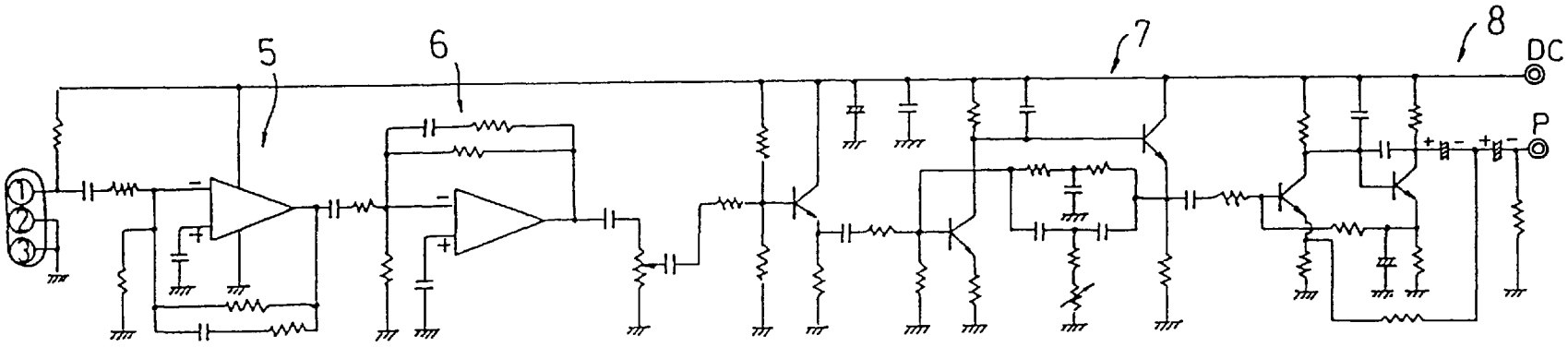
FIG. 38 is an electric circuit diagram showing a part of a receiver used in the method shown in FIG. 37.
Figure 39:
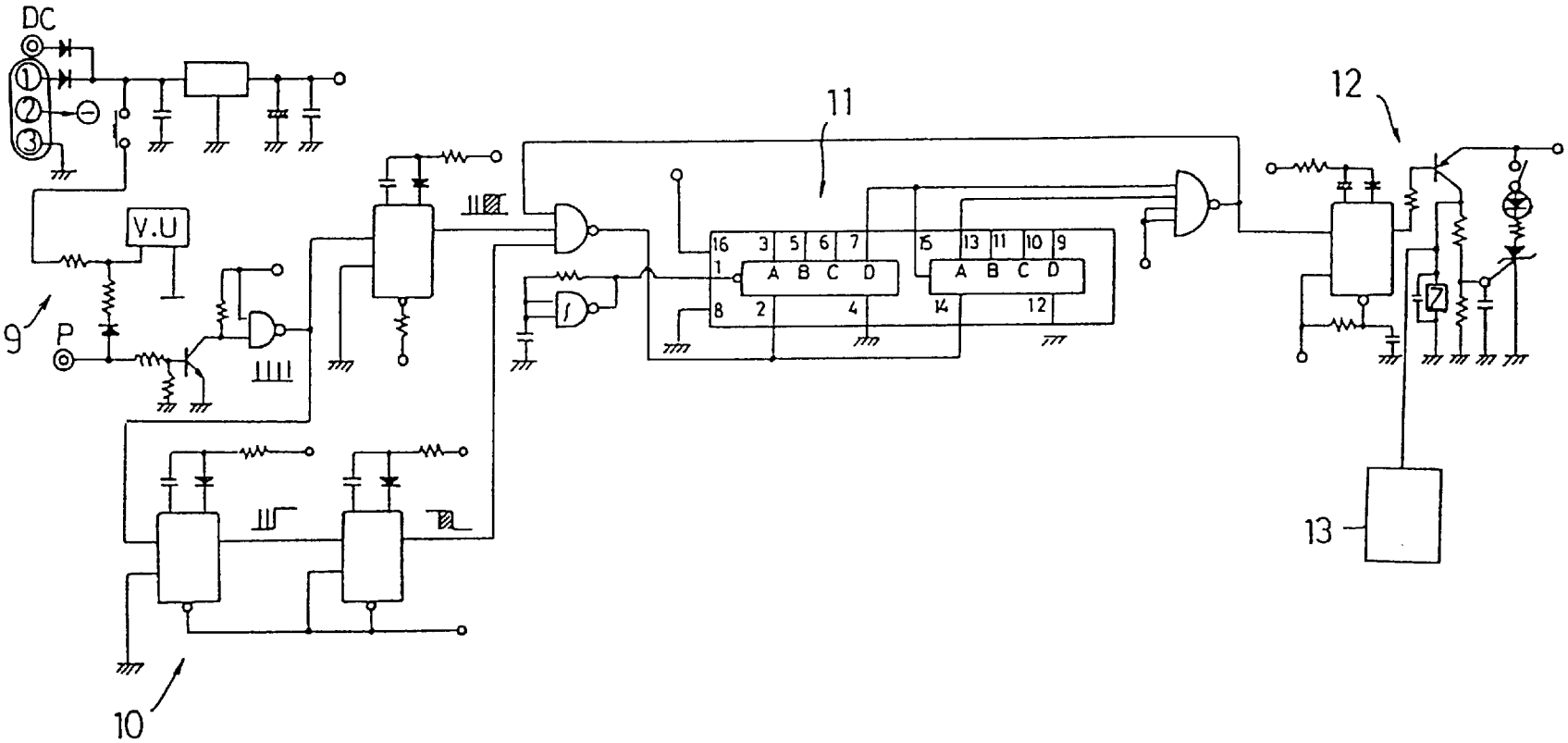
FIG. 39 is an electric circuit diagram showing a part of a receiver connected to the example of FIG. 38.

Now, a crime prevention alarm system in which the crime prevention display device of each of the embodiments constructed as described above may be incorporated will be described hereinafter with reference to FIGS. 37 to 39. The alarm system includes the display device 1 for displaying an article 2 such as a picture. The display device 1 may be the above-described suspension device including the chuck mechanism for gripping the wire W inserted therethrough. The device 1 is provided therein with the alarm generating circuit 3 for generating a sound wave of a predetermined frequency. Also, the alarm system includes a receiver including a microphone 4 collecting the sound wave generated from the alarm circuit 3 and converting it into an electrical signal, amplifiers 5 and 6 each including an amplification circuit for amplifying the electrical signal fed from the microphone 4 thereto, an analog band pass filter 7 for selecting a desired signal component from the amplified signal and converting it into a pulse signal, a buffer amplifier 8, an A/D conversion circuit 9, a digital filter 10 for excluding a particular sound wave component from the pulse signal, and a time filter 11 for distinguishing a digital signal from a false signal. The receiver is also provided with an alarm circuit 12 for generating an alarm signal, which is connected to a centralized control equipment 13 or a crime prevention system equipment.

In such arrangement, when the exhibited article is lifted up in an exhibition hall or room, the alarm generating circuit 3 of the crime prevention suspension device is actuated to generate a particular sound wave of 2700 to 3400 Hz and preferably 3000 Hz to warn of the abnormality. The sound wave thus generated is then collected by the microphone 4 such as, for example, a carbon microphone, a capacitor microphone, a dynamic microphone or the like arranged on a ceiling of the exhibition room, a wall thereof or the like and then amplified through the amplifiers 5 and 6 of a preamplifier circuit as shown in FIG. 38.

Subsequently, in order to exclude any unnecessary sound from the signal thus suitably adjusted, it is passed through the analog band pass filter 7, so that required signal components having frequencies centering around 3000 Hz may be amplified to a high degree. Then, the analog signal is fed to the buffer amplifier 8, to thereby be subject to waveform shaping, followed by feeding to the A/D converter 9, resulting in being converted into a pulse signal. Thereafter, the pulse signal is passed through the digital filter 10, so that components other than those having frequencies of 3000±300 Hz are removed. Then, in order to distinguish the analog signal from a false signal contained in music or the like, the analog signal is passed through the time filter 11, so that continuous generation of a particular sound wave signal for a predetermined period of time (seconds) or more is detected for selecting the signal. Thereafter, the signal is fed to a final gate and then used for actuating the alarm circuit 12 of the receiver, so that an alarm signal such as sound of the buzzer, light of a lamp or the like may be generated. Then, the alarm signal thus output from the receiver is fed to the centralized control equipment 13, to thereby permit the crime prevention alarm system to exhibit a safe and appropriate function without causing any wrong information, resulting in providing satisfactory serviceability.

The alarm generating circuit including the buzzer which is used for the crime prevention display device may be incorporated in a door of an exhibition room, a door of a display case or the like, to thereby detect opening of the door for removal of an exhibited article for theft, resulting in providing an alarm sound. Also, in the crime prevention alarm system, the receiver for alarm detection is incorporated in the centralized control equipment while being connected to thereto. Alternatively, it may be connected to any other guard or crime prevention alarm equipment to constitute a theft prevention system. For example, a centralized control master equipment may be used for carrying out operation control of alarm outputs such as an output of a group identifying lamp, as well as an output of a bell, that of a disaster prevention system, that of a subscriber's telephone and the like based on inputting of an alarm signal thereto for every group or exhibition room, to thereby provide a system for identifying a place at which an exhibited article has been stolen. In such arrangement, a power supply, a buzzer and the like may be arranged on a side of the centralized control master equipment.

Industrial Applicability

As can be seen from the foregoing, the crime prevention display device, exhibit crime prevention alarm control method and apparatus therefor according to the present invention are suitable for constituting a crime prevention system for preventing a theft of an exhibit or an interior or exterior decoration such as a picture, a sculpture, a craftwork, a panel or the like when it is exhibited or displayed in an art museum or any other exhibition hall.

I claim:

1. An exhibit crime prevention alarm control method comprising the steps of:

mounting an exhibit so that it is supported by an exhibit preventing alarm device;

generating an alarm sound by an alarm sound generating means incorporated in the exhibit crime prevention alarm device when the exhibit is removed from the support of the exhibit crime prevention alarm device;

collecting the alarm sound to obtain an electrical wave signal characteristic of the alarm sound;

converting the electrical wave signal into a pulse signal by means of an A/D conversion circuit;

removing signal components other than those having frequencies within a predetermined range, centering around a frequency of a particular sound wave, from the pulse signal by means of a digital filter;

inputting the pulse signal to a time filter to detect continuous generation of the electrical wave signal for a predetermined period of time or more; and activating an alarm circuit to generate an alarm signal of a different type than the alarm sound.

2. An exhibit crime prevention alarm control method as defined in claim 1, further comprising the step of amplifying said collected alarm signal by means of an amplification circuit, followed by conversion of the alarm signal into the pulse signal.

3. The exhibit crime prevention alarm control method of claim 1, wherein the alarm signal is a sound alarm signal.

4. The exhibit crime prevention alarm control method of claim 1, wherein the exhibit crime prevention alarm is activated to generate an alarm device sound when the weight of an exhibit is removed from the exhibit crime prevention alarm device.

5. The exhibit crime prevention alarm control method of claim 1, wherein the alarm signal is a lamp being lit.

6. The exhibit crime prevention alarm control method of claim 1, further comprising the step of feeding the alarm signal to a centralized control equipment to carry out operation control of alarm outputs based on the alarm signal.

7. The exhibit crime prevention alarm control method of claim 6, wherein the operation control by the centralized control equipment includes identifying a place at which an exhibit is removed from the exhibit crime prevention alarm device.

8. The exhibit crime prevention alarm control method of claim 6, wherein the operation control by the centralized control equipment includes outputting through a subscriber's telephone.

9. An exhibit and display crime prevention alarm apparatus comprising:

a display device including a holder, a chuck mechanism for gripping a wire inserted therethrough, a load detection means for detecting a variation in any applied load, a spring member mounted between the chuck mechanism and the holder to support the load whereby removal of the load will activate the load detection means, and an alarm generating circuit for generating a sound wave of a predetermined frequency when the load detection means detects a variation in the load; and a receiver including a microphone for collecting the sound wave generated from said alarm generating circuit and converting it into an electrical signal, an amplification circuit for amplifying the electrical signal fed from said microphone thereto, an analog filter including an A/D conversion circuit for selecting a desired signal component from the amplified signal and converting it into a pulse signal, a digital filter for excluding a particular sound wave component from the pulse signal, and a time filter for distinguishing a digital signal from a false signal;

said receiver being provided with an alarm circuit for generating an alarm signal.

10. An exhibit and display crime prevention alarm apparatus as defined in claim 9, wherein said alarm generating circuit includes a buzzer;

said buzzer being received in a resonance chamber formed in said display device.

* * * * *